US009213266B2

(12) United States Patent
Toba

(10) Patent No.: US 9,213,266 B2
(45) Date of Patent: Dec. 15, 2015

(54) DEVELOPMENT APPARATUS AND CARTRIDGE WITH SEALING MEMBER TO PREVENT LEAKAGE OF DEVELOPER

(71) Applicant: Canon Kabushiki Kaisha, Tokyo (JP)

(72) Inventor: Shinjiro Toba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/975,806

(22) Filed: Aug. 26, 2013

(65) Prior Publication Data

US 2014/0064777 A1 Mar. 6, 2014

(30) Foreign Application Priority Data

Sep. 5, 2012 (JP) ..... 2012-194998

(51) Int. Cl.
*G03G 15/08* (2006.01)

(52) U.S. Cl.
CPC ..... *G03G 15/0898* (2013.01); *G03G 15/0817* (2013.01); *G03G 2221/1684* (2013.01)

(58) Field of Classification Search
CPC ..... G03G 15/0898
USPC ..... 399/103, 105
See application file for complete search history.

(56) References Cited

U.S. PATENT DOCUMENTS 6,424,811 B1 7/2002 Tsuda et al.
6,519,431 B1 2/2003 Toba et al.
6,542,706 B2 4/2003 Toba et al.
6,549,736 B2 4/2003 Miyabe et al.
6,603,939 B1 8/2003 Toba et al.
6,678,488 B2 1/2004 Toba et al.
6,836,629 B2 12/2004 Miyabe et al.
6,937,834 B2 8/2005 Kanno et al.
6,990,302 B2 1/2006 Toba et al.
7,149,457 B2 12/2006 Miyabe et al.
7,158,736 B2 1/2007 Sato et al.
7,164,875 B2 1/2007 Miyabe et al.
7,212,768 B2 5/2007 Numagami et al.
7,218,882 B2 5/2007 Toba et al.
7,224,925 B2 5/2007 Sato et al.
7,248,810 B2 7/2007 Miyabe et al.
7,349,657 B2 3/2008 Sato et al.
7,412,193 B2 8/2008 Sato et al.
7,715,746 B2 5/2010 Tanabe et al.

(Continued)

FOREIGN PATENT DOCUMENTS

JP 62208073 A * 9/1987
JP 07-160116 H 6/1995

(Continued)

*Primary Examiner* — Susan Lee
(74) *Attorney, Agent, or Firm* — Fitzpatrick, Cella, Harper & Scinto

(57) ABSTRACT

A developing apparatus for an image forming apparatus includes a frame having a developer container; a developing roller; a blade for regulating a developer layer thickness on the roller, the blade including a base end portion supported by the frame, and a free end portion contacted to the roller; and an elastic seal provided between the frame and the blade to prevent leakage of the developer from the developer container in an axial direction of the roller at an end portion, wherein in a state before the roller is mounted to the frame, a thickness of the seal, measured in a compression direction in which the seal is compressed by the blade, is larger in a free end portion side than in a base end portion side with respect to a direction crossing with the axial direction.

26 Claims, 16 Drawing Sheets

(56) References Cited

U.S. PATENT DOCUMENTS

| | | | |
|---|---|---|---|
| 7,860,433 | B2 | 12/2010 | Toba et al. |
| 7,894,733 | B2 | 2/2011 | Tanabe et al. |
| 7,953,340 | B2 | 5/2011 | Tanabe et al. |
| 8,213,831 | B2 | 7/2012 | Toba et al. |
| 8,301,054 | B2 | 10/2012 | Tanabe et al. |
| 8,521,060 | B2 | 8/2013 | Numata et al. |
| 2013/0243481 | A1 | 9/2013 | Toba et al. |

FOREIGN PATENT DOCUMENTS

| | | |
|---|---|---|
| JP | 2009-265325 | 11/2009 |
| JP | 2011-237607 | 11/2011 |

* cited by examiner (a)

(b)

(a)

(b)

DEVELOPMENT APPARATUS AND CARTRIDGE WITH SEALING MEMBER TO PREVENT LEAKAGE OF DEVELOPER

FIELD OF THE INVENTION AND RELATED ART

The present invention relates to a development apparatus (device) and a cartridge.

It has been a common practice to provide an image forming apparatus which uses an electrophotographic image formation process is provided with a development device for developing an electrostatic latent image formed on a photosensitive drum as an image bearing member. The development device is provided with a development frame in which toner as developer is stored, and a rotatable development roller as a developer bearing member.

There is positioned a development blade as a developer layer thickness regulating member, in the adjacencies of the development roller. This development blade regulates in thickness the layer of toner borne (coated) on the peripheral surface of the development roller to form a toner layer having a preset thickness. The development blade extends across the entire range of the development roller in terms of the direction (which hereafter may be referred to simply as "lengthwise direction") of the rotational axis of the development roller. It is supported by a metallic support formed of a piece of steel plate or the like, in such a manner that one of its lengthwise edge portions is layered upon the metallic support. Hereafter, this integrated combination of the metallic blade support and development blade will be referred to as "development blade unit".

The development device has a development end sealing member as a development blade bottom seal, as a developer sealing member for preventing toner from leaking from the development unit through the gaps between the development roller and development frame and the gaps between the development blade unit and development frame.

The development end seal is positioned in the adjacencies of both of the lengthwise ends of the development roller, between the development roller and development device frame, to prevent the toner from leaning out of the development frame at the lengthwise ends of the development roller.

The development blade bottom seal prevents the toner from leaking out of the development frame, by being airtightly adhered to the aforementioned end seal, on the rear side of the development blade unit, in such a manner that it fills the gap between the development frame and development blade unit.

As the development blade is placed in contact with the development roller, the blade is made to deform, by the reaction force resulting from the contact between the development blade and development roller, in such a manner that its center portion in terms of the lengthwise direction is likely to separated from the development roller.

On the other hand, the development blade is attached to the development frame in such a manner that the end seals and bottom seals are sandwiched between the lengthwise end portions of the development blade and development frame, being thereby compressed. Therefore, the contact pressure between each end seal and development roller, and the contact pressure between each bottom seal, are likely to be higher across the end portion than the center portion in terms of the range of contact in terms of the lengthwise direction.

If the area of contact is nonuniform in contact pressure in terms of the lengthwise direction, the development blade is likely to be nonuniform in its ability to electrically charge toner, which in turn is likely to cause an image forming apparatus to output an image which is nonuniform in density in terms of the lengthwise direction.

For example, there is disclosed in Japanese Laid-open Patent Application H07-160116, a method for making the lengthwise end portions of a development blade longer in the free length (distance from developer regulating edge of development blade to base edge of development blade) than the center portion of the development blade, by partially cutting away the lengthwise end portions of the metallic support plate for the development blade, in the direction perpendicular to the lengthwise direction. With the use of this method, it is possible to set the contact pressure between the development blade and development roller to be less across the lengthwise end portions of the development blade the than the center portion, to make the development blade uniform in its contact pressure upon the development roller in terms of the lengthwise direction.

SUMMARY OF THE INVENTION

The primary object of the present invention is to reduce the occurrence of nonuniformity in image density, by reducing the contact pressure of a development blade (regulating member), across its lengthwise end portions in terms of the direction parallel to the axial line of the development roller (developer bearing member, in order to minimize the problem that an image forming apparatus outputs an image which is nonuniform in density.

According to an aspect of the present invention, there is provided a developing apparatus for use with an image forming apparatus, comprising a frame; a developer accommodating portion formed by said frame; a developer carrying member, provided in said frame, for developing a latent image formed on the image bearing member with a developer; a regulating member for regulating a layer thickness of the developer carried on said developer carrying member, said regulating member including a base end portion supported by said frame, and a free end portion contacted to said developer carrying member; and a sealing member provided between said frame and said regulating member to prevent leakage of the developer from said developer accommodating portion in an axial direction of said developer carrying member at an end portion of said developer carrying member with respect to the axial direction, said sealing member having an elasticity, wherein in a state before said developer carrying member is mounted to said frame, a thickness of said sealing member, measured in a compression direction in which said sealing member is compressed by said regulating member, is larger in a free end portion side than in a base end portion side with respect to a direction crossing with the axial direction.

According to another aspect of the present invention, there is provided a cartridge detachably mountable to a main assembly of an image forming apparatus; the cartridge comprising a frame; a developer carrying member, provided in said frame, for developing a latent image formed on the image bearing member with a developer; a regulating member for regulating a layer thickness of the developer carried on said developer carrying member, said regulating member including a base end portion supported by said frame, and a free end portion contacted to said developer carrying member; and a sealing member provided between said frame and said regulating member to prevent leakage of the developer from said developer accommodating portion in an axial direction of said developer carrying member at an end portion of said developer carrying member with respect to the axial direction, said sealing member having an elasticity, wherein in a state before said developer carrying member is mounted to said frame, a thickness of said sealing member, measured in a compression direction in which said sealing member is compressed by said regulating member, is larger in a free end portion side than in a base end portion side with respect to a direction crossing with the axial direction.

Further, features of the present invention will become apparent from the following description of exemplary embodiments (with reference to the attached drawings).

DESCRIPTION OF THE PREFERRED EMBODIMENTS

Hereinafter, the embodiments of the present invention are described with reference to the appended drawings. However, the measurements, materials, and shapes of the structural components in the following embodiments of the present invention, and the positional relationship among the structural components, are to be modified according to the structure of the apparatus to which the present invention is applied, and various conditions under which the apparatuses are used. That is, they are not intended to limit the present invention in scope.

Embodiment 1

The electrophotographic image forming apparatus (which may be referred to simply as "image forming apparatus", hereafter) in this embodiment is an electrophotographic full-color image forming apparatus in which four process cartridges (which may be referred to simply as "cartridge") are removably installable. However, this embodiment is not intended to limit the present invention in terms of the number of cartridges which are removably installable in this image forming apparatus; the number of cartridges removably installable is to be suitably set as necessary. For example, in the case of an image forming apparatus for forming a monochromatic image, the number of cartridge to be installed in the apparatus has only to be one. Further, the image forming apparatus in this embodiment is a full-color laser print which is based on four primary colors and uses an electrophotographic process. However, this embodiment is not intended to limit the present invention. That is, the present invention is applicable to an image forming apparatus other than the one in this embodiment. For example, it is applicable to a copying machine, a facsimile machine, or an image forming apparatus capable of performing the functions of two or more of the preceding machines.

<Image Forming Apparatus>

Figure 1:
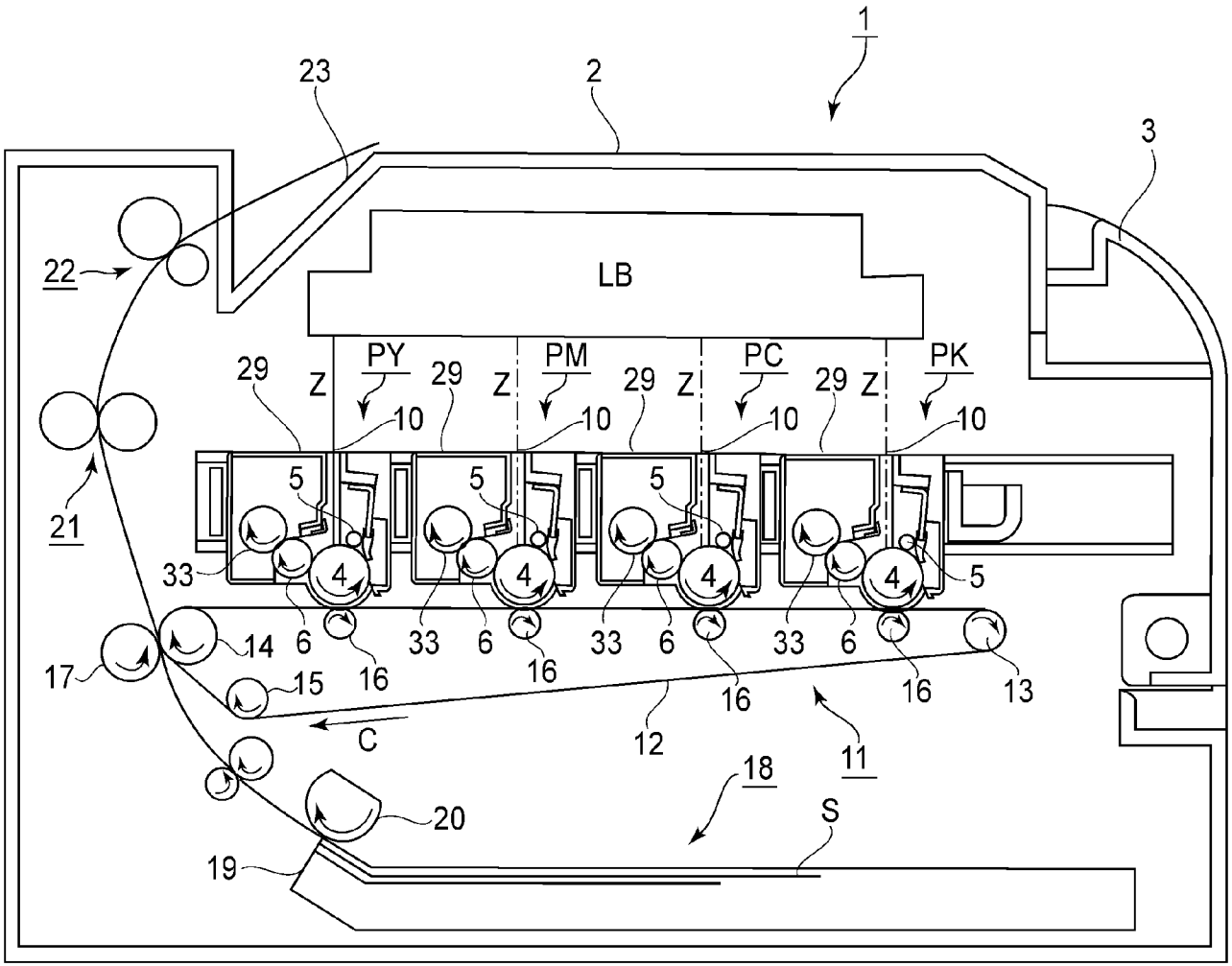
FIG. 1 is a schematic sectional view of the image forming apparatus in the first embodiment of the present invention, and shows the structure of the apparatus.
Figure 2:
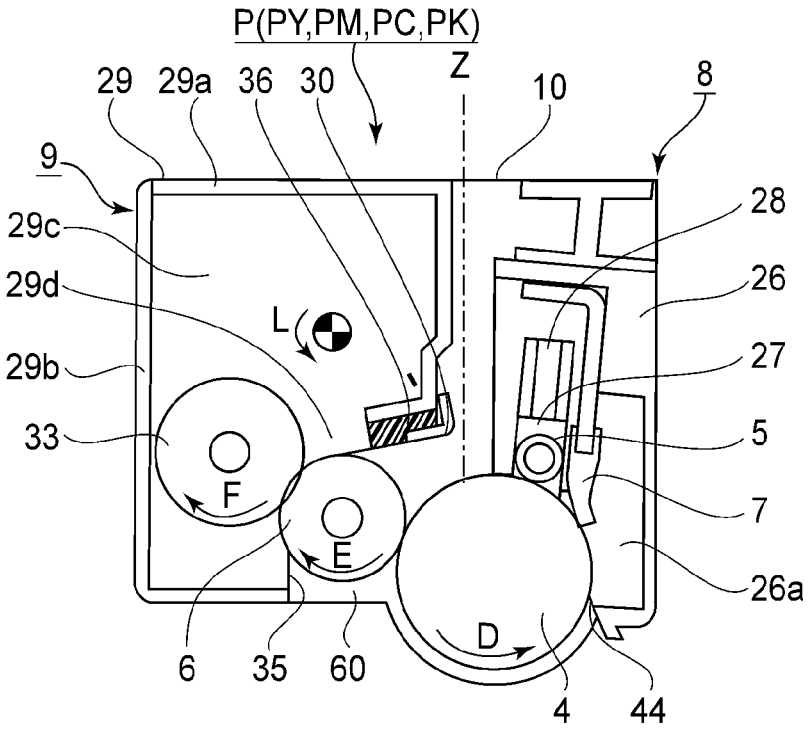
FIG. 2 is a schematic sectional view of the cartridge in the first embodiment, and shows the structure of the cartridge.

First, referring to FIGS. 1 and 2, the overall structure of the image forming apparatus 1 in this embodiment is described. FIG. 1 is a schematic sectional view of the image forming apparatus 1 in this embodiment. It shows the structure of the apparatus 1. FIG. 2 is a schematic sectional view of the cartridge in this embodiment. It shows the structure of the cartridge. The image forming apparatus 1 in this embodiment is of the cartridge type. That is, it forms a color image on a sheet S of recording medium with the use of cartridges which are removably installable in the apparatus main assembly 2.

Incidentally, in the following description of this embodiment, regarding the direction of the image forming apparatus 1, the side of the apparatus 1, which is provided with a door 3 is referred to as the front side (front surface) of the apparatus. The opposite surface of the apparatus 1 from the front surface is referred to as the rear surface (back surface). Further, the right and left sides of the image forming apparatus 1 as seen from the front surface side, are referred to as drive side and non-drive sides, respectively. Regarding FIG. 2, a seal 36 for the bottom side of the development blade (which will be described later) is simplified in terms of its shape. The description of the detailed shape of the development blade bottom seal 36 is given later.

In this embodiment, the first-fourth cartridges P (PY, PM, PC and PK) which are removably installed in the apparatus main assembly 2 have four similar electrophotographic process systems, one for one, although they are different in the color of the toner they store. To each of the first-fourth cartridges P (PY, PM, PC and PK), bias voltage (charge bias, development bias, etc.) are supplied from the apparatus main assembly 2.

The first cartridge PY stores yellow (Y) toner in its development frame 29. It forms a toner image of the yellow color, on the peripheral surface of its photosensitive drum 4. The second cartridge PM stores magenta (M) toner in its development frame 29. It forms a toner image of the magenta color, on the peripheral surface of its photosensitive drum 4. The third cartridge PC stores cyan (C) toner in its development frame 29. It forms a toner image of the cyan color, on the peripheral surface of its photosensitive drum 4. The fourth cartridge PK stores black (K) toner in its development frame 29. It forms a toner image of the black color, on the peripheral surface of its photosensitive drum 4.

Referring again to FIG. 1, there is provided a laser scanner unit LB as an exposing means, above the group of the first-fourth cartridges P (PY, PM, PC and PK). This laser scanner unit LB outputs a beam Z of laser light in response to the information of the image to be formed. The beam Z of laser light scans (exposes) the peripheral surface of the photosensitive drum 4, through the exposure window 10 of the cartridge P.

Also referring to FIG. 1, there is provided an intermediary transfer belt unit 11 as a transferring means below the group of the first-fourth cartridges P (PY, PM, PC and PK). This intermediary transfer belt unit 11 has a driver roller 13, a turn roller 14, and a tension roller 15. It has also a flexible transfer belt 12, which is suspended by the preceding three rollers 13, 14 and 15. The transfer belt 12 is suspended so that it can be circularly moved in the direction indicated by an arrow mark C in FIG. 1.

The photosensitive drum 4 in each of the first to fourth cartridges P (PY, PM, PC and PK) is in contact with the top surface of the transfer belt 12, by its bottom surface. The area of contact between the photosensitive drum 4 and transfer belt 12 is the primary transfer station, in which the toner image formed on the photosensitive drum 4 is transferred (primary transfer) onto the transfer belt 12. On the inward side of the transfer belt 12, in terms of the loop which the transfer belt 12, a primary transfer roller 16 is positioned so that it opposes the photosensitive drum 4. Further, against the turn roller 14, a secondary transfer roller 17 is kept pressed, with the presence of the transfer belt 12 between itself and the turn roller 14. The area of contact between the transfer belt 12 and secondary transfer roller 17 is the secondary transfer station in which the toner image having been transferred (primary transfer) onto the transfer belt 12 is to be transferred (secondary transfer) onto a sheet S of recording medium.

There is provided a recording medium feeding/conveying unit 18 below the intermediary transfer belt unit 11. This recording medium feeding/conveying unit 18 has a sheet feeder tray 19, in which multiple sheets S of recording medium are stored in layers, and a sheet feeder roller 20. Further, there are provided a fixation unit 21 and a discharger unit 22 in the top left portion (in FIG. 1) of the internal space of the apparatus main assembly 2. The top surface of the apparatus main assembly 2 serves as a delivery tray 23. To the sheet S of recording medium, the toner image thereon is fixed by the fixing means with which the above described fixation unit 21 is provided. Then, the sheet S is discharged onto the above described delivery tray 23.

<Image Forming Operation>

Next, referring to FIG. 1, the image forming operation of the image forming apparatus 1 in this embodiment is described. First, the photosensitive drums 4 in the first to fourth cartridges P (PY, PM, PC and PK) begin to be rotationally driven (in counterclockwise direction indicated by arrow mark D in FIG. 2) at a preset speed. At the same time, the laser scanner unit LB begins to be driven. In synchronism with the driving of the laser scanner unit LB, the charge roller 5 in each cartridge P uniformly charges the peripheral surface of the photosensitive drum 4 to a preset polarity and a preset potential level. The laser scanner unit LB scans (exposes) the peripheral surface of each photosensitive drum 4 with the beam Z of laser light which it outputs while modulating the beam Z with the image signals which correspond to the primary colors. Consequently, an electrostatic latent image, which reflects the image formation signals which correspond one for one to the primary colors, is formed on the peripheral surface of each photosensitive drum 4. Then, the formed electrostatic latent image is developed by the development roller 6 which is being rotationally driven (in clockwise direction in FIG. 1, indicated by arrow mark E in FIG. 2) at a preset speed.

Through the electrophotographic image formation process such as the one described above, a toner image of the yellow color, which corresponds to the yellow component of the full-color image, is formed on the photosensitive drum 4 of the first cartridge PY. Then, this toner image is transferred (primary transfer) onto the transfer belt 12. Similarly, on the photosensitive drum 4 of the second cartridge PM, a toner image of the magenta color which corresponds to the magenta component of the full-color image is formed. Then, this toner image is transferred (primary transfer) onto the intermediary transfer belt 12 in such a manner that it is layered on the toner image of the yellow color, which has been transferred onto the transfer belt 12. Similarly, on the photosensitive drum 4 of the third cartridge PC, a toner image of the cyan color, which corresponds to the cyan component of the full-color image is formed. Then, this toner image is transferred (primary transfer) onto the transfer belt 12 in such a manner that it is layered upon the toner image of the yellow color and the toner image of the magenta color, which have already been transferred onto the transfer belt 12. Similarly, on the photosensitive drum 4 of the fourth cartridge PK, a toner image of the black color, which corresponds to the black component of the full-color image, is formed. Then, this toner image is transferred (primary transfer) onto the transfer belt 12 in such a manner that it is layered on the toner image of the yellow color, toner image of the magenta color, and toner image of the cyan color.

Through the above described processes, an unfixed full-color toner image is effected on the transfer belt 12 by the yellow, magenta, cyan and black toner images. Meanwhile, the sheets S of recording medium are separated one by one from the rest, with a preset control timing, and conveyed. Then, each sheet S of recording medium is introduced into the secondary transfer station, which is the area of contact between the secondary transfer roller 17 and transfer belt 12, with a preset control timing. Consequently, the layered four toner images, different in color, on the transfer belt 12 are transferred together onto the sheet S of recording medium, as if they are peeled away from the transfer belt 12, while the sheet S is conveyed through the above described secondary transfer station.

Thereafter, the sheet S of recording medium, onto which the layered four toner images, different in color, have been transferred, is conveyed to the fixation unit 21, in which it is subjected to pressure and heat, being thereby fixed to the sheet S. Then, the sheet S to which the toner images have just been fixed, is discharged onto the delivery tray 23 by a discharge unit. Through the above-described operational sequence, the image forming operation is ended.

<Structure of Cartridge>

Figure 3:
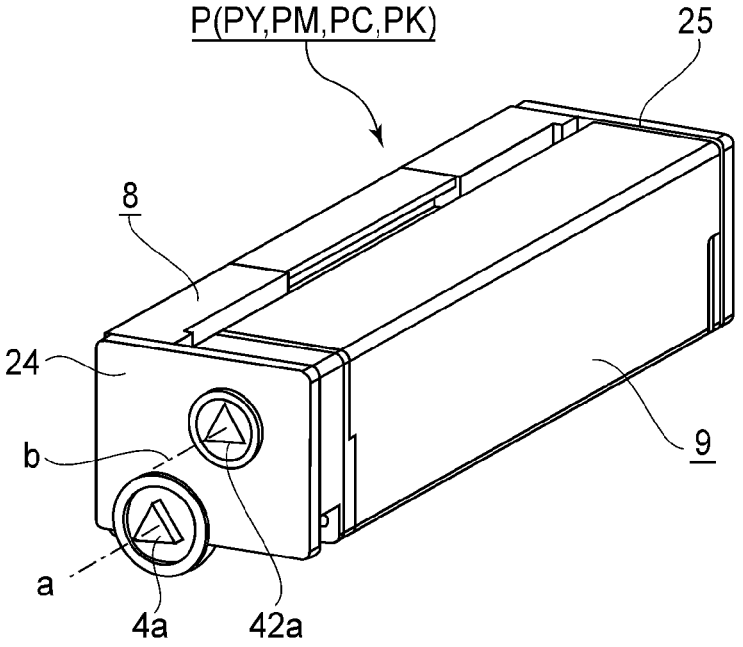
FIG. 3 is an external perspective view of the cartridge in the first embodiment.

Next, referring to FIGS. 2 and 3, the structure of the cartridge in this embodiment is described. FIG. 3 is an external perspective view of the cartridge in this embodiment. As is evident from FIG. 3, the cartridges P (PY, PM, PC and PK) are roughly in the form of a rectangle parallelepiped, the lengthwise direction of which is parallel to the direction of the rotational axis a of the photosensitive drum 4 (which may be referred to simply as "lengthwise direction", hereafter). Each cartridge P has a cleaning unit 8, a development device 9, a cover 24 on the drive side, a cover 25 on the non-drive side. The cleaning unit 8 and development device 9 are in connection to each other.

Referring to FIG. 2, the cleaning unit 8 is made up of the photosensitive drum 4, charge roller 5, and a cleaning unit container 26 which has a cleaning blade 7. Next, referring to FIG. 3, the photosensitive drum 4 is rotatably supported by the drive side cover 24 and non-drive side cover 25. It rotates (in direction indicated by arrow mark D in FIG. 2) by obtaining the driving force of the motor (unshown) of the apparatus main assembly 2 through the drum drive coupling 4*a*. The charge roller 5 is rotatably supported by the pair of charge roller bearings 27 of the cleaning device container 26, by its lengthwise end portions. It is kept in contact with the peripheral surface of the photosensitive drum 4, being thereby rotated by the rotation of the photosensitive drum 4. It charges the peripheral surface of the photosensitive drum 4 by being supplied with charge bias. In order to ensure that the peripheral surface of the photosensitive drum 4 is uniformly charged, the lengthwise ends of the charge roller 5 are pressed upon the peripheral surface of the photosensitive drum 4, by a pair of compression springs 28, one for one.

The cleaning blade 7 is fixed to the cleaning device container 26, and is placed in contact with the peripheral surface of the photosensitive drum 4 in such a manner that its cleaning edge made of elastic rubber is placed in contact with the peripheral surface of the photosensitive drum 4 in the counter direction relative to the rotational direction (direction indicated by arrow mark D in FIG. 2). The cleaning blade 7 cleans the peripheral surface of the photosensitive drum 4 by scraping away the transfer residual toner remaining on the peripheral surface of the photosensitive drum 4. In order to ensure that the transfer residual toner is completely scraped away, the cleaning edge of the cleaning blade 7 is kept pressed upon the peripheral surface of the photosensitive drum 4 with the application of a preset amount of pressure.

Further, the transfer residual toner scraped away from the peripheral surface of the photosensitive drum 4 by the cleaning blade 7 is stored as waste toner in the waste toner storage 26*a* of the cleaning device container 26. Therefore, the cleaning device container 26 is provided with a waste toner recovery sheet 44 for preventing the waste toner from leaking out of the container 26 through the gap between the photosensitive drum 4 and container 26, and the gap between the container 26 and cleaning blade 7. The waste toner recovery sheet 44 is positioned so that it extends in the lengthwise direction of the photosensitive drum 4. Further, the lengthwise end portions of the cleaning blade 7 are provided with a pair of cleaning blade end seals (unshown) one for one.

The cartridge in this embodiment is made up of the photosensitive drum 4, and the processing means for processing the photosensitive drum 4, more specifically, the development roller 6 as a developing means, cleaning blade 7 as a cleaning means, and waste toner storage 26*a*, which are unitized as parts of the cartridge. However, this embodiment is not intended to limit the present invention in terms of the cartridge. For example, one or more among the photosensitive drum 4, developing mans, charging means, and cleaning means, may be unitized as parts of the cartridge, so that they can be removably installable in the apparatus main assembly 2.

<Structural Arrangement for Allowing Cartridge to be Removably Installed>

Figure 4:
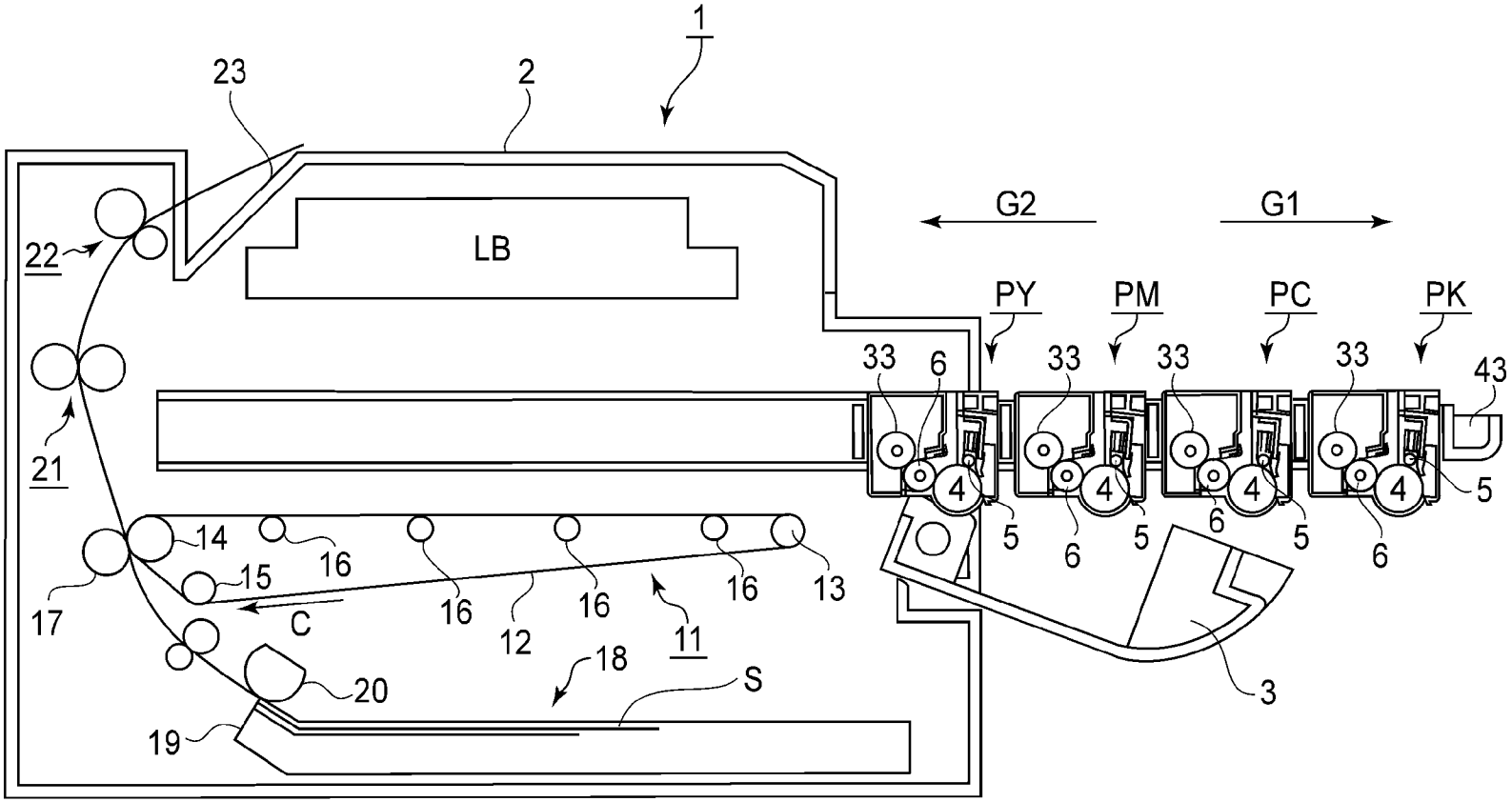
FIG. 4 is a schematic sectional view of the image forming apparatus in the first embodiment when the cartridge tray of the apparatus is in its outermost position into which it can be pulled out of the main assembly of the apparatus.
Figure 5:
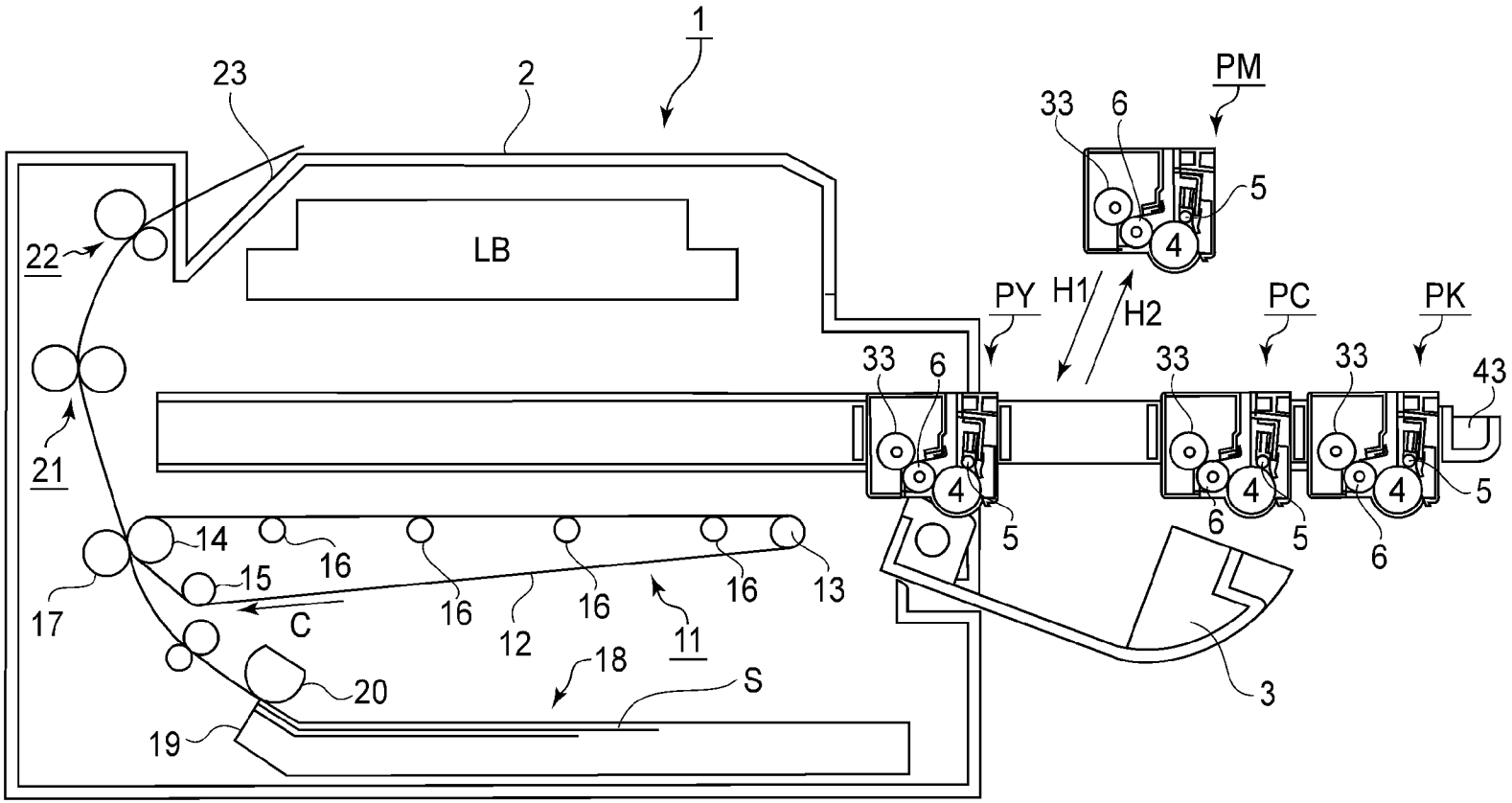
FIG. 5 is a schematic sectional view of the image forming apparatus, which shows the operation for installing a cartridge into the cartridge tray, and the operation for removing a cartridge from the cartridge tray.

Next, referring to FIGS. 4 and 5, the operation for installing the cartridge P (PY, PM, PC or PK) into the apparatus main assembly 2, or removing the cartridge P from the apparatus main assembly 2, is described. FIG. 4 is a schematic sectional view of the image forming apparatus 1 when the cartridge tray is in the outermost position into which the cartridge is pulled out, and in which the cartridges can be installed into, or removed from, the cartridge tray. FIG. 5 is a schematic sectional view of the image forming apparatus 1, which shows the operation for installing a cartridge into the cartridge tray, or removing a cartridge from the cartridge tray. The apparatus main assembly 2 is provided with the cartridge tray 43 in which the cartridges P are removably installable. Referring to FIG. 4, the apparatus main assembly 2 is structured so that the cartridge tray 43 is linearly movable (can be pushed into, or pulled out of, apparatus main assembly 2) in the directions G1 and G2, which are practically parallel to the horizontal direction of the apparatus main assembly 2. The cartridge tray 43 can be positioned in its cartridge tray home position which is in the apparatus main assembly 2, and the outermost positioned into which the cartridge tray 43 can be pulled out of the apparatus main assembly 2.

First, the operation for installing the cartridges P (PY, PM, PC and PK) into the apparatus main assembly 2 is described. To begin with, a user (operator) is to open the apparatus door 3, and move the cartridge tray 43 in the direction indicated by the arrow mark G1 in FIG. 4, so that the cartridge tray 46 will be in its outermost position. It is when the cartridge tray 43 is in the state shown in FIG. 5 that the cartridge can be installed into the cartridge tray 43 in the direction indicated by an arrow mark H1 in FIG. 5, and is held in the tray 43. Then, the cartridge tray 43 in which the cartridges P are held is to be moved in the direction indicated by an arrow mark G2 in FIG. 4, so that the cartridge tray 43 will be positioned in its home position in the apparatus main assembly 2. Then, the user is to close the door 3 to end the installation of the cartridges P into the apparatus main assembly 2 as shown in FIG. 1.

Next, the operation for removing the cartridge P from the apparatus main assembly 2 is described. Referring to FIG. 4, the user is to move the cartridge tray 43 into the cartridge removal position, or the outermost position, in the same manner as the manner in which the cartridge tray 43 is moved to install the cartridge P into the apparatus main assembly 2. It is when the cartridge tray 43 is in the state shown in FIG. 5 that the cartridge P can be removed from the cartridge tray 43 in the direction indicated by an arrow mark H2 in FIG. 5 to complete the operation for removing the cartridge P from the apparatus main assembly 2. That is, the cartridges P are removably installable in the apparatus main assembly 2 through the above described operation.

<Structure of Development Device>

Figure 6:
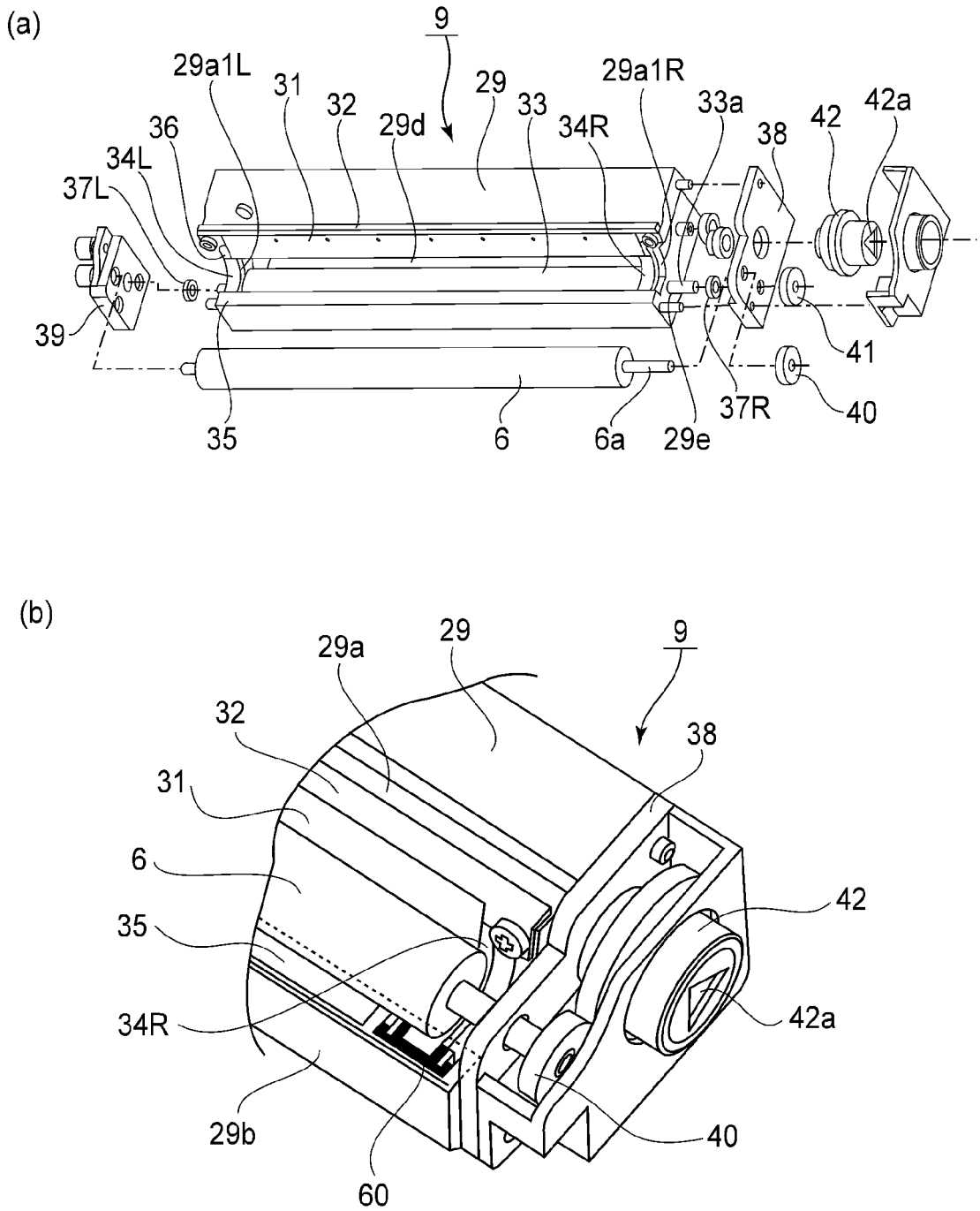
FIG. 6 is a drawing of the development device in the first embodiment.
Figure 7:
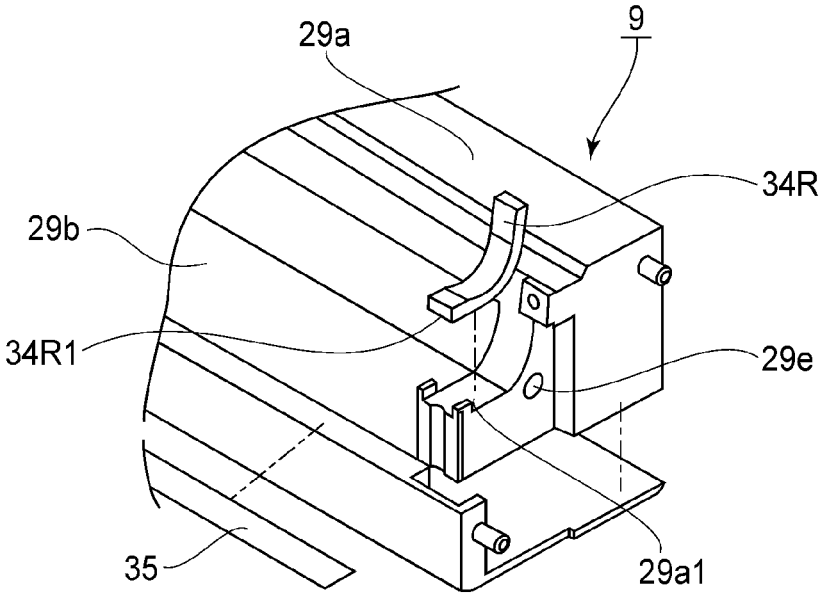
FIG. 7 is an enlarged perspective view of the drive side of the development device, in the first embodiment.
Figure 7:
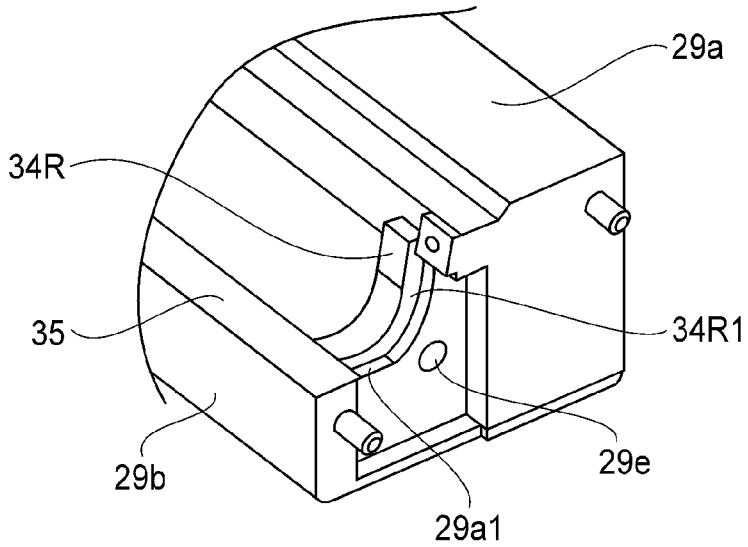

Next, referring to FIGS. 6 and 7, the details of the development device 9 in this embodiment are described. FIG. 6(*a*) is an exploded perspective view of the development device 9 in this embodiment, and FIG. 6(*b*) is an enlarged perspective view of the drive side of the development device 9 in this embodiment. FIG. 7(*a*) is an enlarged, exploded, and perspective view of the drive side of the development device 9 in this embodiment, and FIG. 7(*b*) is an enlarged perspective view of the non-drive side of the development device 9 in this embodiment.

Referring to FIGS. 3 and 6(*a*), the development device 9 is in the form of a rectangular parallelepiped, the lengthwise direction of which is parallel to the direction of the axial line (which may be referred to as "lengthwise direction" hereafter) of the development roller 6 as a developer bearing member. The development device 9 has a development frame 29, a development blade 31 as a regulating member, a developer supply roller 33, a pair of developer end seals 34R and 34L as second sealing members, a flexible sheet 35, and a pair of supply roller shaft seals 37R and 37L, in addition to the development roller 6.

The development frame 29 is made up of the first frame 29*a* to which the development roller end seals 34R and 34L are attached, and a second frame 29*b* to which the flexible sheet 35 is attached. The first and second frames 29*a* and 29*b* are welded to each other by ultrasonic welding or the like, whereby the toner storage chamber 29*c* as the developer storage for storing toner, and an opening 29*d* through which toner is released from the toner storage chamber 29*c*, are created.

The development roller 6 is positioned so that in order for the development roller 6 to bear the toner discharged from the toner storage chamber 29*c*, it extends from one end of the opening 29*d* to the other in terms of the lengthwise direction. Further, the developer supply roller 33 is positioned so that it hypothetically invades into the development roller 6 in the radius direction of the developer supply roller 33. Next, referring to FIG. 6(*a*), the development roller 6 and developer supply roller 33 are rotatably supported by the drive side bearings 38 and non-drive side bearings 39 attached to the lateral walls of the development frame 29, one for one, by their ends in terms of the direction parallel to their axles. Referring also to FIG. 6(*a*), the drive side end of the core 6*a* of the development roller 6 is fitted with a development roller gear 40, and the drive side end of the core 33*a* of the developer supply roller 33 is fitted with a developer supply roller gear 41. The development roller gear 40 and developer supply roller gear are in mesh with the development drive input gear 42. The development drive input gear 42 is provided with a development drive coupling 42*a*, with which the drive output coupling (unshown) with which the apparatus main assembly 2 is provided is in engagement to transmit the driving force of the motor (unshown) to the development drive coupling 42*a* to rotationally drive the development roller 6 and developer supply roller 33 at a preset speed. The developer supply roller 33 is rotatable in the direction indicated by an arrow mark F in FIG. 2.

The development blade 31 is a piece of thin and elastic metallic plate, which is roughly 0.1 mm in thickness. It is positioned so that its free edge in terms of its widthwise direction is placed in contact with the development roller 6 in the counter direction relative to the rotational direction (indicated by arrow mark E in FIG. 2). Further, referring to FIG. 2, the development blade bottom seal 36 as the first seal is positioned so that it fills the gap between the development frame 29 and development blade unit 30, across the entirety of the gap in terms of the lengthwise direction, to prevent toner leak.

Referring also to FIG. 6(*a*), the development end seals 34R and 34L are positioned at the lengthwise ends of the opening of the development frame 29, to prevent toner from leaking from the development device through the gap between the development blade 31 and development frame 29, and the gap between the development roller 6 and development frame 29. The detailed description of the structure of the development end seals 34R and 34L is given later with reference to FIG. 8.

The flexible sheet 35 shown in FIGS. 6(*a*) and 6(*b*) is made of plastic film made of polyethylene-terephthalate, polyphenylene sulfide, etc., for example. It is roughly 50 μm in thickness. The flexile sheet 35 is positioned so that it contacts the development roller 6, on the opposite side of the opening 29*d* of the development frame 29 from the development blade 31. It prevents toner from leaking through the gap between the development frame 29 and development roller 6.

Next, referring to FIG. 6(*b*), in order to plug the gap formed by the first frame 29*a*, second frame 29*b*, development end seal 34R and flexible sheet 35, an elastic seal 60 is fitted in the gap to prevent toner leak. Further, the gap formed by the first frame 29*a*, second frame 29*b*, development end seal 34L and flexible sheet 35 is similarly filled with elastic seal 60 to prevent toner leak. The elastic seal 60 is formed of thermoplastic resin such as polystyrene. It is desired to be no less than 110-300 mPa·s in viscosity when it is in the melted state.

The developer supply roller shaft seals 37R and 37L shown in FIG. 6(*a*) are attached to the portions of the core 33*a* of the developer supply roller 33, which are exposed outward from the development frame 29. They prevent toner from leaking through the gap between the wall of a hole 29*e* with which the development frame 29 is provided to allow the core 33*a* of the developer supply roller 33 to be put through the lateral wall of the development frame 29, and the core 33*a*.

The development device 9 is kept pressured by the compression springs (unshown) in such a manner that it is pivotally moved about the pivot (axial line b) shown in FIG. 3 in the direction (indicated by arrow mark L in FIG. 2) to place the development roller 6 in contact with the photosensitive drum 4. During an image forming operation, the development roller 6 is kept in contact with the photosensitive drum 4, whereas when no image is formed, the development roller 6 is kept separated from the photosensitive drum 4 by an unshown separating means, against the resiliency of the above described compression springs. That is, when an image is formed, the development roller 6 is placed in contact with the photosensitive drum 4, whereas when no image is formed, the development roller 6 is kept separated from the photosensitive drum 4; the development roller 6 is repeatedly placed in contact with, or separated from, the photosensitive drum 4.

When an image is formed, the developer supply roller 33 and development roller 6 are rotationally driven while rubbing against each other. Thus, the toner in the development frame 29 is borne on the development roller 6. The development blade 31 regulates in thickness the toner layer formed on the peripheral surface of the development roller 6, and also, gives toner triboelectric charge in the interface between itself and development roller 6, by being kept pressed upon the development roller 6. Thus, the charged toner on the development roller 6 adhere to the electrostatic latent image on the photosensitive drum 4, developing thereby the latent image, in the area of contact between the development roller 6 and photosensitive drum 4.

<Structure of Development End Seal>

Figure 8:
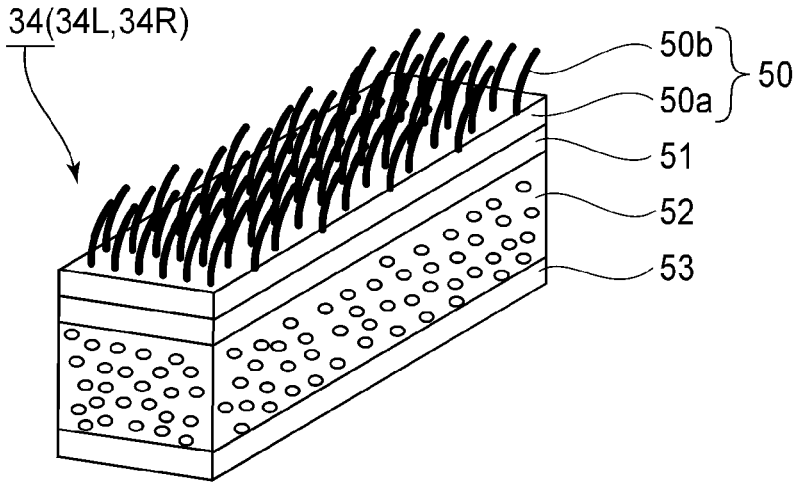
FIG. 8 is an external perspective view of a development end sealing member.

Next, referring to FIG. 8, the structure of the development end seal 34 is described. FIG. 8 is an external perspective view of the development end seal 34. As shown in FIG. 8, the development end seal 34 is made up of a surface layer, an adhesive layer 51, an intermediary layer 52, and an adhesive layer 53. The development end seal 34 is attached so that it remains compressed between the lengthwise end portions of the development roller 6 in terms of the direction parallel to the axial line of the development roller 6, and the development frame 29. More concretely, it is positioned between the development end seal seat 29*a*1 (FIGS. 7 and 15) of the development frame 29 and the development roller 6. It has a sealing function to prevent toner leaking through the gap between the development frame 29 and development roller 6.

Referring to FIG. 8, in this embodiment, the surface layer 50 is made up of a substrative cloth 50*a* and multiple upright strands 50*b* of fiber implanted in the substrative cloth 50*a*. However, this embodiment is not intended to limit the present invention in terms of the surface layer 50. For example, the surface layer 50 may be made up of the substrative cloth and multiple short strands of fiber electrostatically implanted in the substrative cloth, or the substrative cloth alone. The surface layer 50 is attached to the surface of the intermediary layer 52 with the placement of the adhesive layer 51, for example, a piece of two-sided adhesive tape, a layer of adhesive, or the like, between the surface layer 50 and intermediary layer 52. As the material for the strands of fiber, synthetic fiber made of polyethylene, polypropylene, polyester, Nylon, acrylic resin, polyethylene-terephthalate, or the like, semi-synthetic fiber made of rayon or the like, natural fiber such as cotton, may be used. Further, the combination of the preceding materials, and the twined version of the preceding materials, may also be listed as the material for the strands.

The intermediary layer 52 is a cushion layer formed of elastic substance. As the material for the intermediary layer 52, a foamed version of synthetic resin such as polyurethane may be used. In this embodiment, the abovementioned elastic seal 60 to be formed of thermoplastic resin, and development blade bottom seal 36 as the first sealing member, are formed so that they airtightly contact the intermediary layer 52 of the development end seal 34 as the second sealing member. More specifically, the thermoplastic resin, which is kept melted at a high level of temperature, is filled into the aforementioned gap. Thus, the melted thermoplastic resin penetrates into the cells of the intermediary layer 52 (made of foamed substance). Thus, the gap (space) formed by the development end seal 34, elastic seal 60 formed of thermoplastic resin, and development blade bottom seal 36 is airtightly filled.

The adhesive layer 53 is formed of two-sided adhesive tape, pressure sensitive adhesive, or the like. The material for the adhesive layer 53 may be other material than the abovementioned ones, as long as it allows the adhesive layer 53 to be flexible and is adherent enough to ensure that the adhesive layer 53 remains adhered to the intermediary layer 52. As for the shape of the development end seal 34, it may be different from the one in this embodiment. For example, a part or parts of the development end seal 34 may be carved away to make the shape of the development end seal 34 conform to the shape of the development end seal seat 29*a*1 (FIGS. 7 and 15), and the structure of the adjacencies of the seat 29*a*1.

<Structure of Development Blade Unit>

Figure 9:
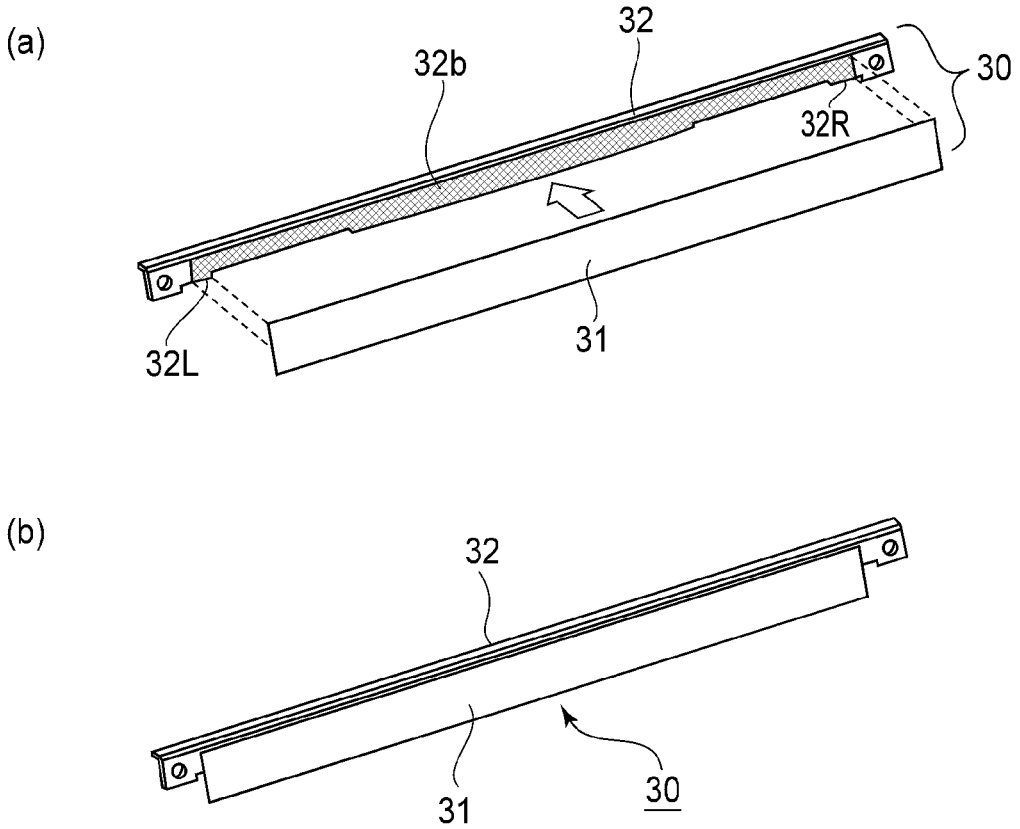
FIG. 9 is an exploded perspective view of the development blade unit, which is for showing the steps through which the development blade is attached to the development blade supporting metallic plate.
Figure 10:
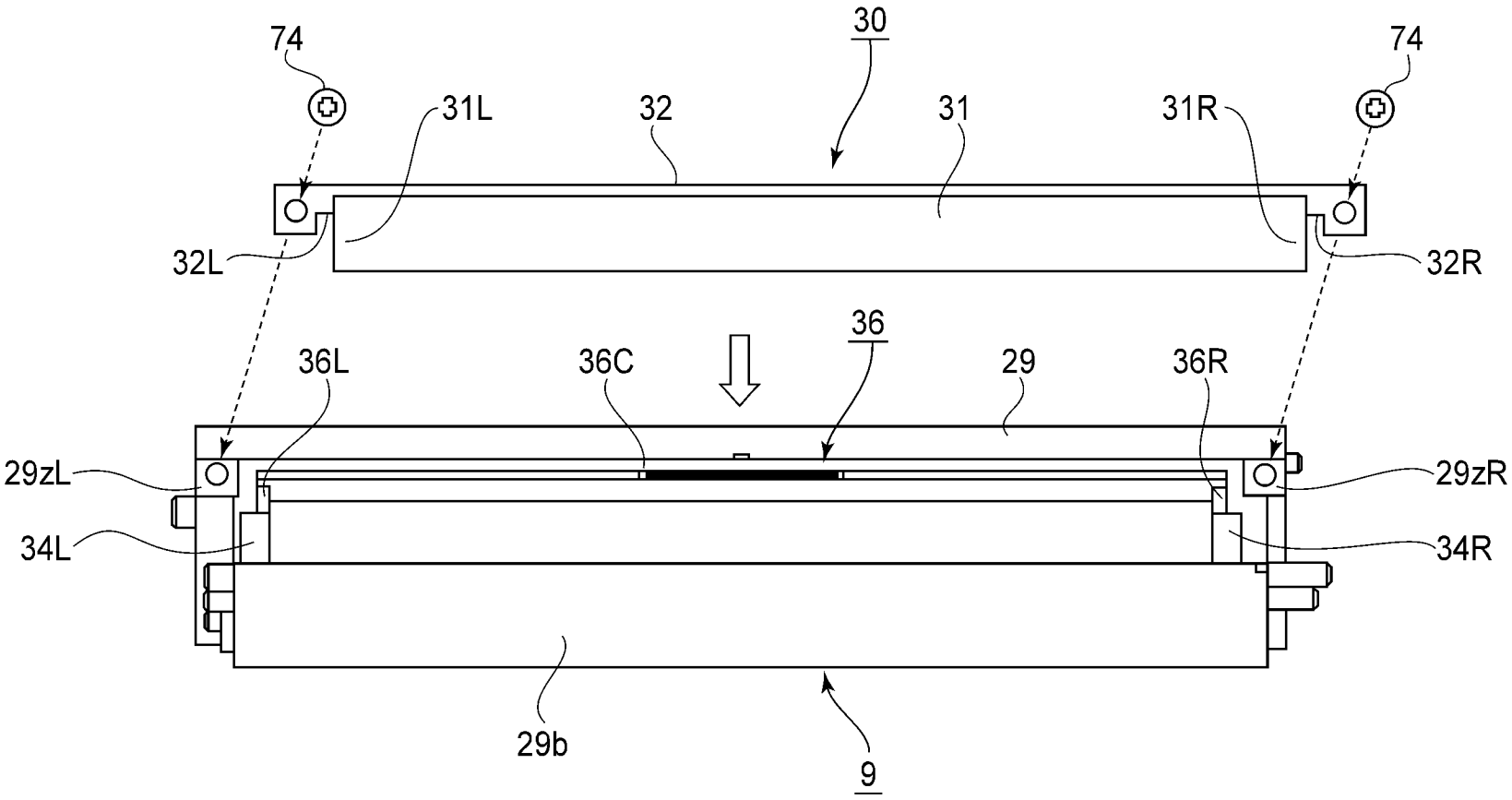
FIG. 10 is a partially exploded front view of the development blade unit, which is for showing the steps through which the development blade unit is attached to the development frame.

Next, referring to FIGS. 9 and 10, the details of the structure of the development blade unit 30 are described. FIG. 9 is an exploded perspective view of the development blade unit 30 and is for describing the process for attaching the development blade 31 to the metallic support. FIG. 10 is an exploded front view of the development device 9, and is for showing the process for attaching the development blade unit 30 to the development frame 29.

Referring to FIG. 9(*a*), the development blade unit 30 is made up of a metallic support plate 32 made of steel plate, and the development blade 31 made of thin plate of stainless steel or phosphor bronze, which is attached to the metallic support plate 32. The development blade 31 is fixed to the portion of the metallic support plate 32, which corresponds in position to the area of contact 32*b* shown in FIG. 9(*a*). This fixation is done by welding, with the use of adhesive, or the like means. The development blade 31 shown in FIGS. 9(*a*) and 9(*b*) may be such a blade which is formed of thin plate of stainless steel or phosphor bronze. It is coated with polyamide elastomer (PAE) across its portion which is placed in contact with the development roller 6. As for the shape of the development blade 31, the blade 31 may be shaped so that its edge portion, by which it contacts the development roller 6, is L-shaped in cross section. Further, the portion of the surface of the development blade 31, which contacts the development roller 6, may be coated with Nylon or rubber, or a sheet formed of Nylon or rubber may be adhered to the portion of the surface of the development blade 31, which contacts the development roller 6.

As for the material for the development blade 31, instead of a thin plate of stainless steel, a plate of rubber or the like may be used. In such a case, a plate of rubber or the like is fixed to the metallic support plate 32. Regarding the rubber as the material for the development blade 31, urethane rubber, silicon rubber, butyl rubber, or the like can be used. Regarding the material for the metallic support plate 32, in order to prevent the rusting or the like of the metallic support plate 32 from negatively affecting the development, stainless steel is used as the material for the metallic support plate 32. Further, the material for the metallic support plate 32 may be steel plate plated with nickel, zinc, or the like. Referring to FIG. 10, the metallic support plate 32 is fixed to the development blade attachment seats 29*z*L and 29*z*R, with which the lengthwise end portions of the development frame 29 of the development device 9 are provided, with the use of small screws 74 or the like, respectively.

<Development Blade Bottom Seal>

Figure 11:
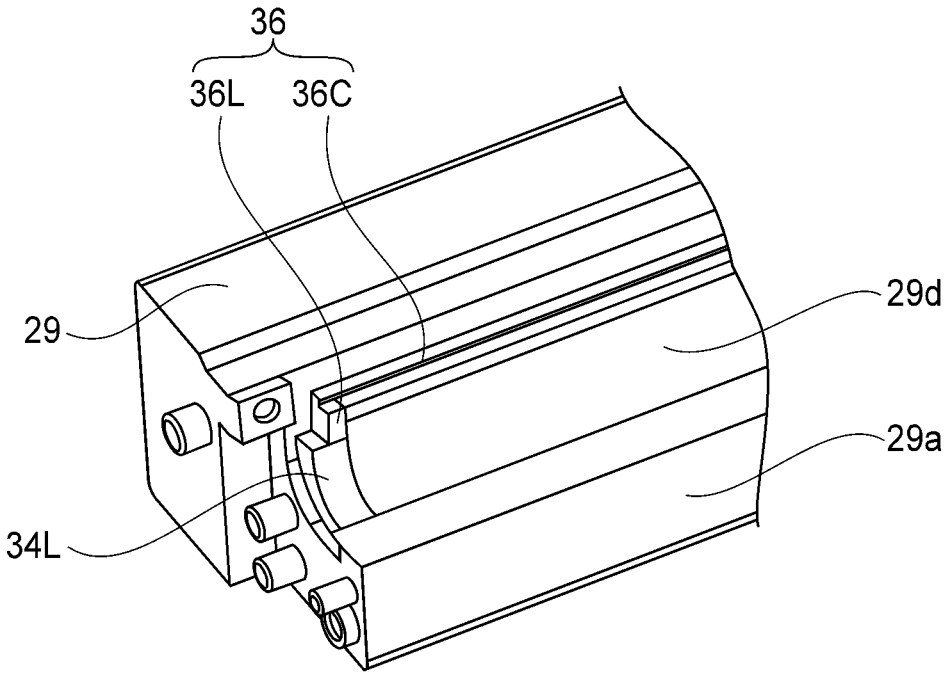
FIG. 11 is a partially exploded perspective view of the development device after the attachment of the development blade bottom seal to the development frame.
Figure 12:
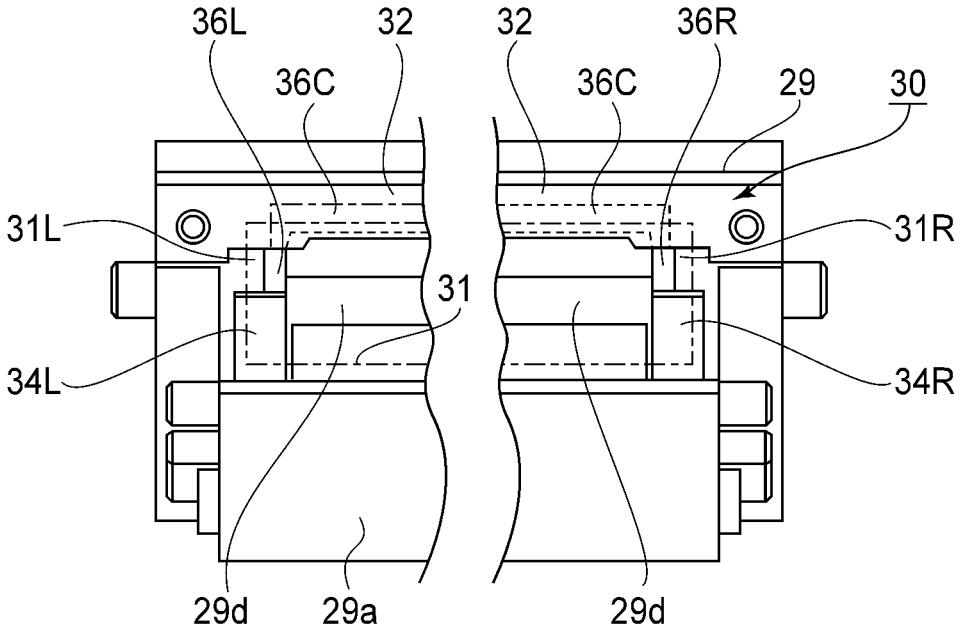
FIG. 12 is a schematic view of the development device after the attachment of the development blade unit to the development frame.

Next, referring to FIGS. 11 and 12, the development blade bottom seal 36 is described. FIG. 11 is a partially broken perspective view of the development device 9, and shows how the development blade bottom seal 36 is attached to the development frame 29. FIG. 12 is a schematic front view of the development device 9 immediately after the development blade unit 30 was attached to the development frame 29. Regarding FIG. 12, the contour of the development blade 31 is indicated by a two-dot chain line.

Referring to FIG. 12, the development blade bottom seal 36 is made up of a center portion 36*c*, and end portions 36L and 36R which contact the development end seal 34L and 34R, respectively, on the opposite side of the development roller 6 from the area of contact between the development blade 31 and development roller 6. The end portions 36L and 36R of the development blade bottom seal 36 are positioned so that they are layered upon the lengthwise end portions of the development blade 31. Referring to FIG. 11, the development device 9 is structured so that the development end seal 34L and the end portion 36L of the development blade bottom seal 36 airtightly contact each other.

Referring to FIG. 12, with the development device 9 being structured as described above, the development blade bottom seal 36 fills the gap between the development blade 31 in such a manner that the center portion 36C of the development blade bottom seal 36 fills the gap between the metallic support plate 32 and development frame 29, and the end portions 36L and 36R fill the gaps formed by the development blade 31, development frame 29, and development end seal 34L and 34R, respectively, whereby the toner within the development frame 29 is prevented from leaking out of the development frame 29 through the development opening 29*d*.

<Molding of Development Blade Bottom Seal>

Figure 13:
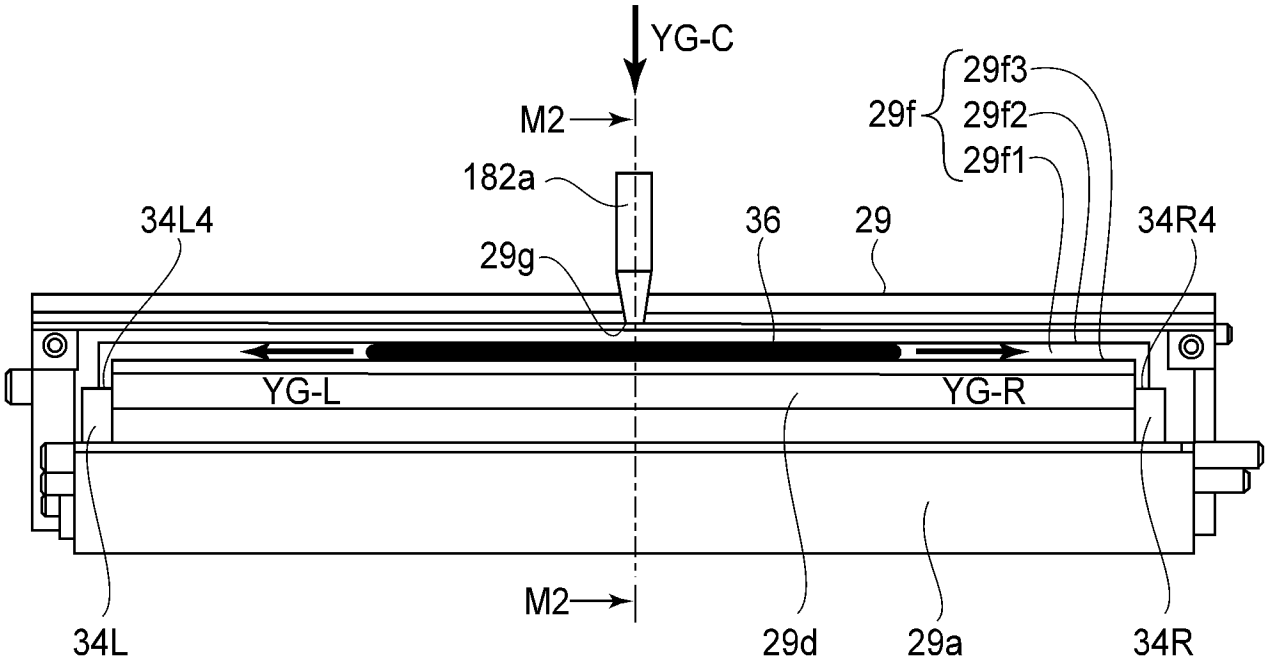
FIG. 13 is a schematic sectional view of the development device, which is for showing the flow of the resin which occurs during the formation of the development blade bottom seal.
Figure 14:
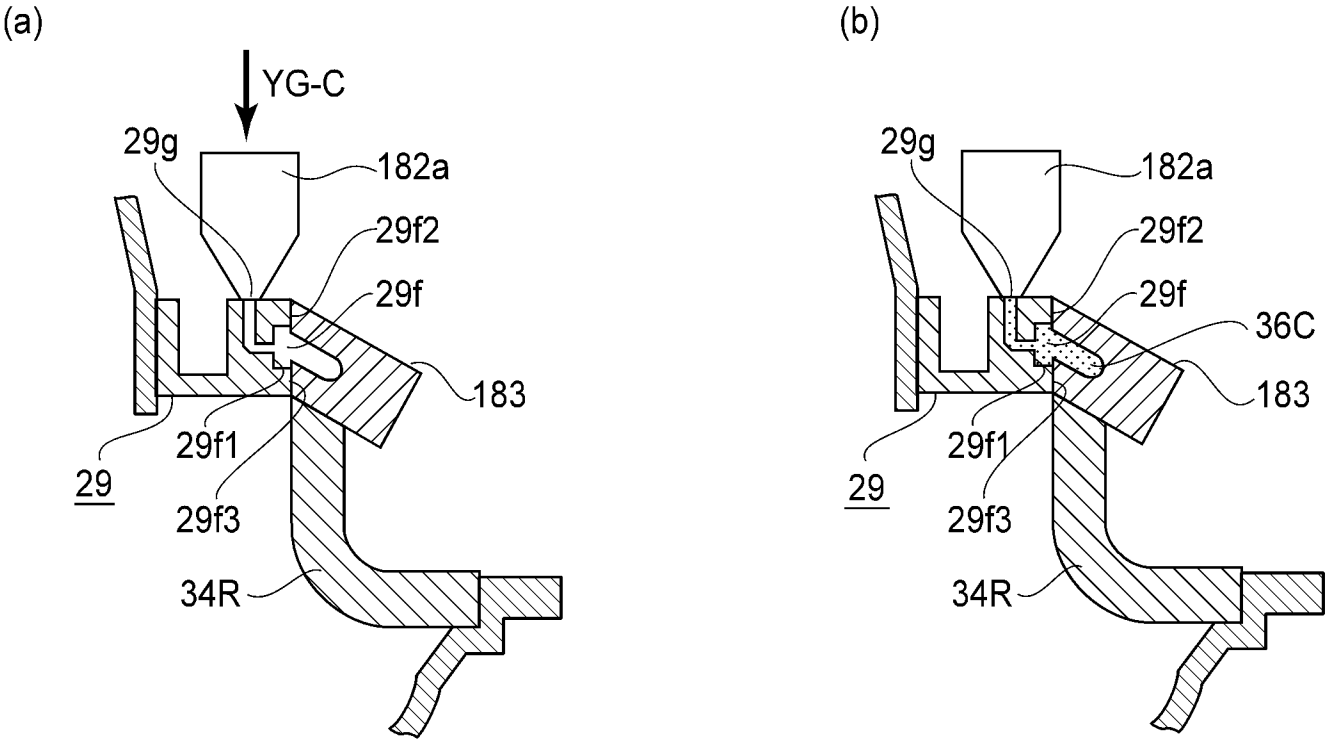
FIG. 14 is a drawing for showing how the development blade bottom seal is formed.

Next, referring to FIGS. 13 and 14, the molding of the development blade bottom seal 36 is described. FIG. 13 is a schematic front view of the development frame 29, which is for showing the resin flow which occurs during the molding of the development blade bottom seal 36. FIG. 14 is a sectional view of the development frame 29 at a plane M2-M2 in FIG. 13. It is for describing the molding of the development blade bottom seal 36 in this embodiment. More specifically, FIG. 14(*a*) is a schematic sectional view of the resin injecting portion of the development frame 29 after the clamping of a seal mold 183. FIG. 14(*b*) is a schematic sectional view of the resin injecting portion of the development frame 29 when the development blade bottom seal 36 is being molded.

The development blade bottom seal 36 in this embodiment is molded of elastic thermoplastic resin, in such a manner that it becomes a virtually integral part of the development frame 29 as it is molded. It is molded by injecting the resin into the space created by the placement of a seal mold 183 in contact with the development frame 29.

Next, referring to FIGS. 13 and 14, the structure for molding the development blade bottom seal 36 is described. Referring to FIG. 13, there is provided above the development opening 29*d* of the development frame 29 (upward direction in FIG. 13), a seal forming portion 29*f* which extends in the lengthwise direction between the development end seal 34L and development end seal 34R. The seal forming portion 29*f* has a recess 29*f*1 into which the seal material is injected, and surfaces (areas) of contact 29*f*2 and 29*f*3 which the mold contact. There is also provided a cylindrical injection opening 29*g*, which is positioned at a preset point in terms of the lengthwise direction, and is in connection to the recess 29*f*1 of the seal forming portion 29*f* as shown in FIG. 13. In this embodiment, only one injection opening 29*g* is provided, which is positioned at roughly the center of the seal formation portion 29*f* in terms of the lengthwise direction. However, the development frame 29 may be structured so that two injection openings 29*g* are provided at roughly the center portion in terms of the lengthwise direction.

Next, the steps to be followed to mold the development blade bottom seal 36 are sequentially described. Referring to FIG. 14(*a*), the first step to be followed for molding the development blade bottom seal 36 is to place the seal mold 183 having a seal-shaped recess 36C, in contact with the surfaces of contact 29*f*2 and 29*f*3 of the seal forming portion 29*f*. Then, the injection nozzle 182*a* of an unshown resin injection apparatus is fitted in the resin injection opening 29*g*, which is at roughly the center of the development frame 29 in terms of the lengthwise direction, from the direction indicated by an arrow mark YG-C in FIGS. 13 and 14(*a*). Then, the thermoplastic elastomer as the material for the development blade bottom seal 36 is to be injected into the injection opening 29*g* of the development frame 29 from the injection nozzle 182*a* of the abovementioned resin injection device.

Then, the thermoplastic elastomer is flowed into the space 29*f* created by the recess 19*f*1 of the seal forming portion 29*f* of the development frame 29 and the seal mold 183 as shown in FIG. 14(*b*). Then, the thermoplastic elastomer flows toward both lengthwise ends, in the directions indicated by arrow marks YG-L and YG-R, respectively, through the space created by the recess 29*f*1 of the seal molding portion 29*f* and the seal mod 183 as shown in FIG. 13. Eventually, the thermoplastic elastomer reaches the portions of the space, which correspond to the ends surface 34L4 and 34R4 of the farthest ends of the development end seals 34L and 34R, in terms of the direction perpendicular to the lengthwise direction, ending thereby the injection of the material for the development blade bottom seal 36.

As the final step, the seal mold 183 is to be retracted to yield the development blade bottom seal 36 shaped as shown in FIG. 11. Incidentally, the method to be used for molding of the development blade bottom seal 36 does not need to be the above described one. For example, the development blade bottom seal 36 may be formed as an integral part of the development frame 29 with the use of two-color molding, insert molding, or the like.

<Shape of Center Portion of Development Blade Bottom Seal>

Figure 15:
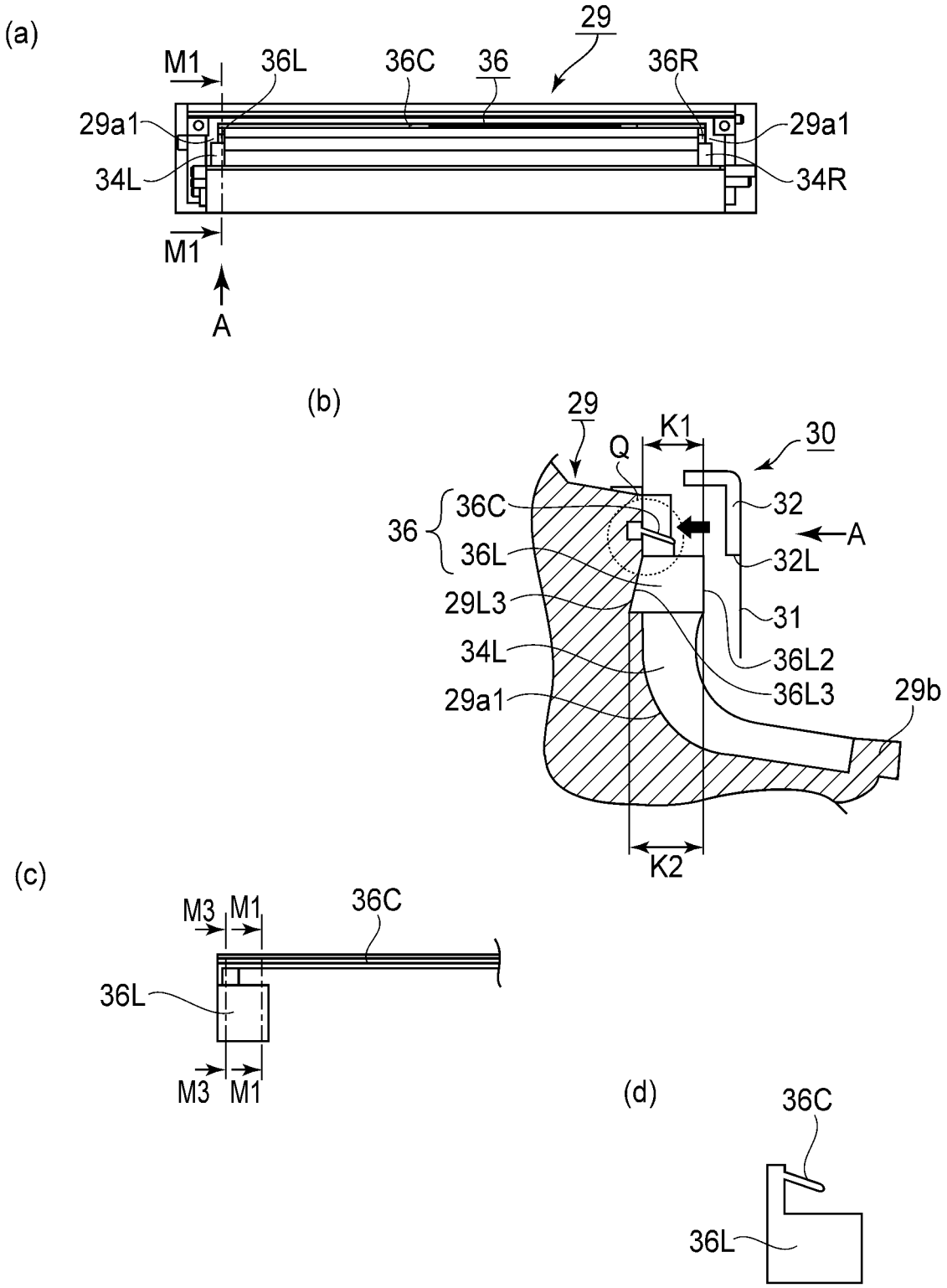
FIG. 15 is a drawing for showing the structure of the development blade bottom seal in the first embodiment.
Figure 16:
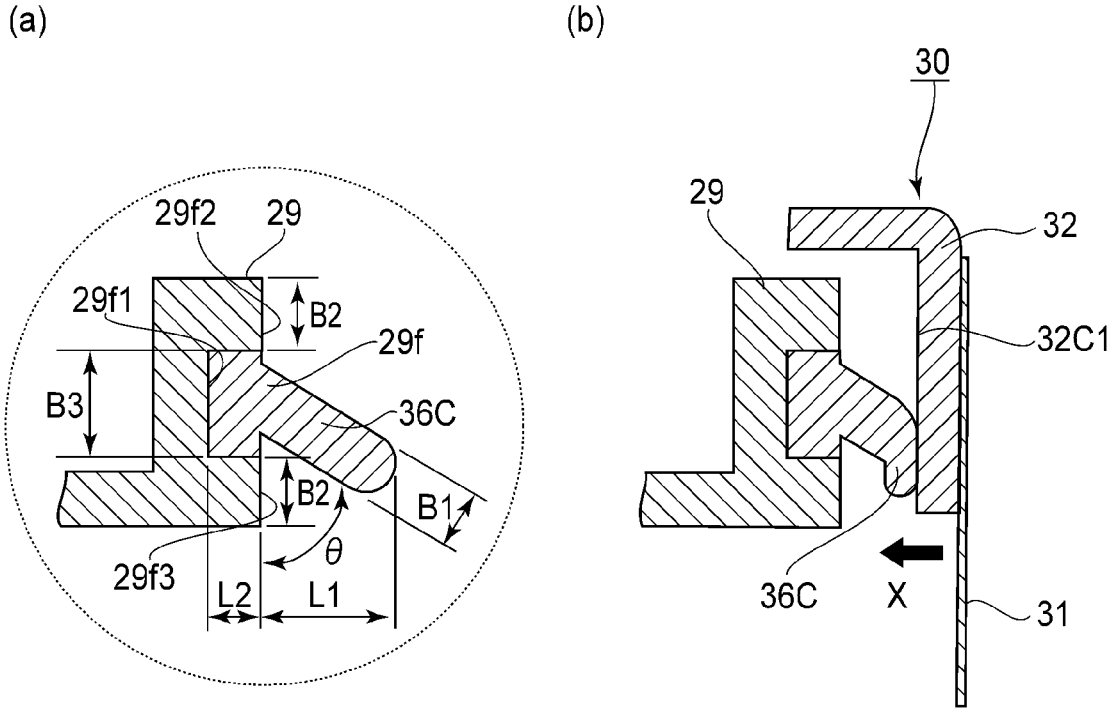
FIG. 16 is a drawing for showing the state of the center portion of the development blade bottom seal in the first embodiment.

Next, referring to FIGS. 15 and 16, the shape of the center portion 36C of the development blade bottom seal 36 in this embodiment is described. FIG. 15 is a drawing for showing the structure of the development blade bottom seal 36 in this embodiment. More specifically, FIG. 15(*a*) is a front view of the development frame 29, and FIG. 15(*b*) is a schematic sectional view of the development frame 29 at the plane M1-M1 in FIG. 15(*a*). FIG. 15(*c*) is a plan view of the development blade bottom seal 36 as seen from the direction indicated by an arrow mark A in FIG. 15(*b*). FIG. 15(*d*) is a schematic sectional view of the development blade bottom seal 36 at a plane M3-M3 in FIG. 15(*c*). FIG. 16 is a drawing for showing the state of the center portion of the development blade bottom seal 36 in this embodiment. More specifically, FIG. 16(*a*) is an enlarged sectional view of the area Q in FIG. 15.

Referring to FIGS. 15(*b*) and 16(*a*), the center portion 36C of the development blade bottom seal 36 is formed as an integral part of the development frame 29, in the recess 29*f*1 of the seal forming portion 29*f* of the development frame 29. Next, referring to FIGS. 15(*c*) and 15(*d*), the development blade bottom seal 36 is an integral combination of the center portion 36C, and end portions 36R and 36L. It keeps sealed between the development frame 29 and development blade unit 30 to prevent toner from leaking out of the development frame 29.

Next, referring to FIG. 16(*a*), which is a sectional view of the center portion 36C of the development blade bottom seal 36 at a plane perpendicular to the lengthwise direction, the center portion 36C of the development blade bottom seal 36 is in the form of a lip which is tilted by an angle of θ relative to the back surface 32C1 of the metallic support plate 32 of the development blade unit 30.

Next, referring to FIG. 16(*b*), the development blade unit 30 is attached to the development frame 29 by being moved in the direction indicated by an arrow mark X. As the development blade unit 30 is moved, the center portion 36C comes into contact with the back surface 32C1 of the metallic support plate 32, and then, is bent in the direction indicated by the arrow mark X, while remaining pinched between the development frame 29 and development blade unit 30. Since the center portion 36C is tilted by the angle of θ relative to the back surface of the metallic support plate 32, the reaction force generated in the lip portion of the center portion 36C of the center portion 36C, by the bending of the lip portion of the center portion 36C of the development blade bottom seal 36 in the direction indicated by the arrow mark X is relatively small.

Here, regarding the amount of the bending of the center portion 36C of the development blade bottom seal 36 in the X direction, is desired to be set to a value within a range of 0.3-1.8 mm, from the standpoint of keeping toner sealed, and the amount of the reaction force of the center portion 36C, to which the development blade unit 30 is subjected. Further, from the standpoint of the moldability of the thermoplastic elastomer, and the accuracy in the measurement of the development frame 29, the lip height L1 and lip width B1 of the center portion 36C of the development blade bottom seal 36 are desired to be set to a value in a range of 2.0-4.0 mm, and a value in a range of 1.0-2.5 mm, respectively. Further, the width B2 of the surfaces 29*f*2 and 29*f*3 of the development frame 29, with which the mold is placed in contact, is desired to be in a range of 1.5-2.0 mm. The width B3 of the recess 29*f*1 is desired to be in a range of 1.5-2.0 mm. Further, the depth L2 of the recess 71*d*1 is desired to be in a range of 0.5-2.0 mm, and the angle of the lip portion is desired to be in a range of 30°-80°.

Because the lip portion of the center portion 36C of the development blade bottom seal 36 is shaped as described above, it is possible to prevent the deformation of the metallic support plate 32. Therefore, it is possible to prevent the increase in the contact pressure between the development blade 31 and development roller 6.

<Shape of End Portion of Development Blade Bottom Seal>

Figure 17:
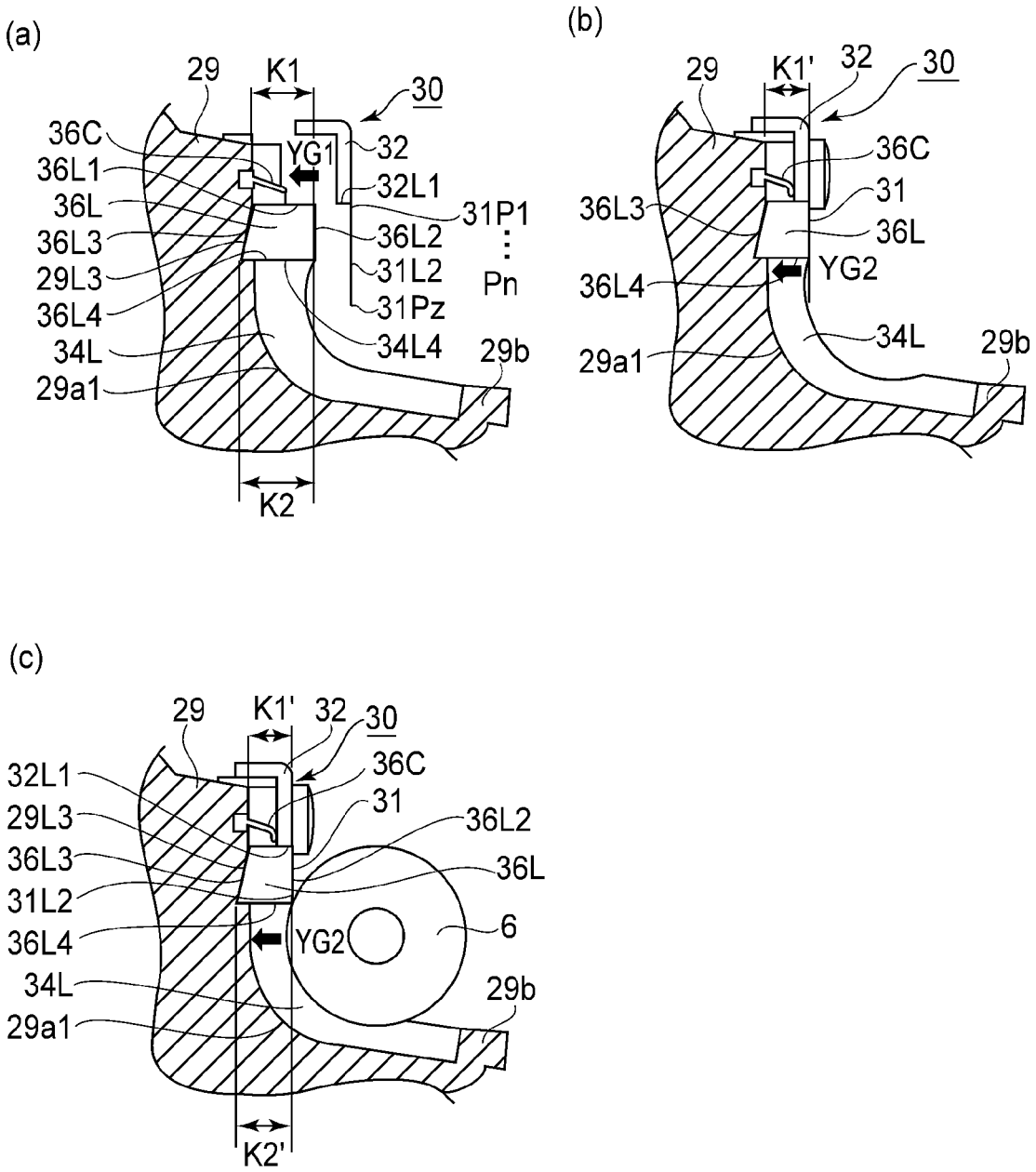
FIG. 17 is a schematic sectional view of a part of the development device, which is for describing the attachment of the development blade unit and development roller.
Figure 18:
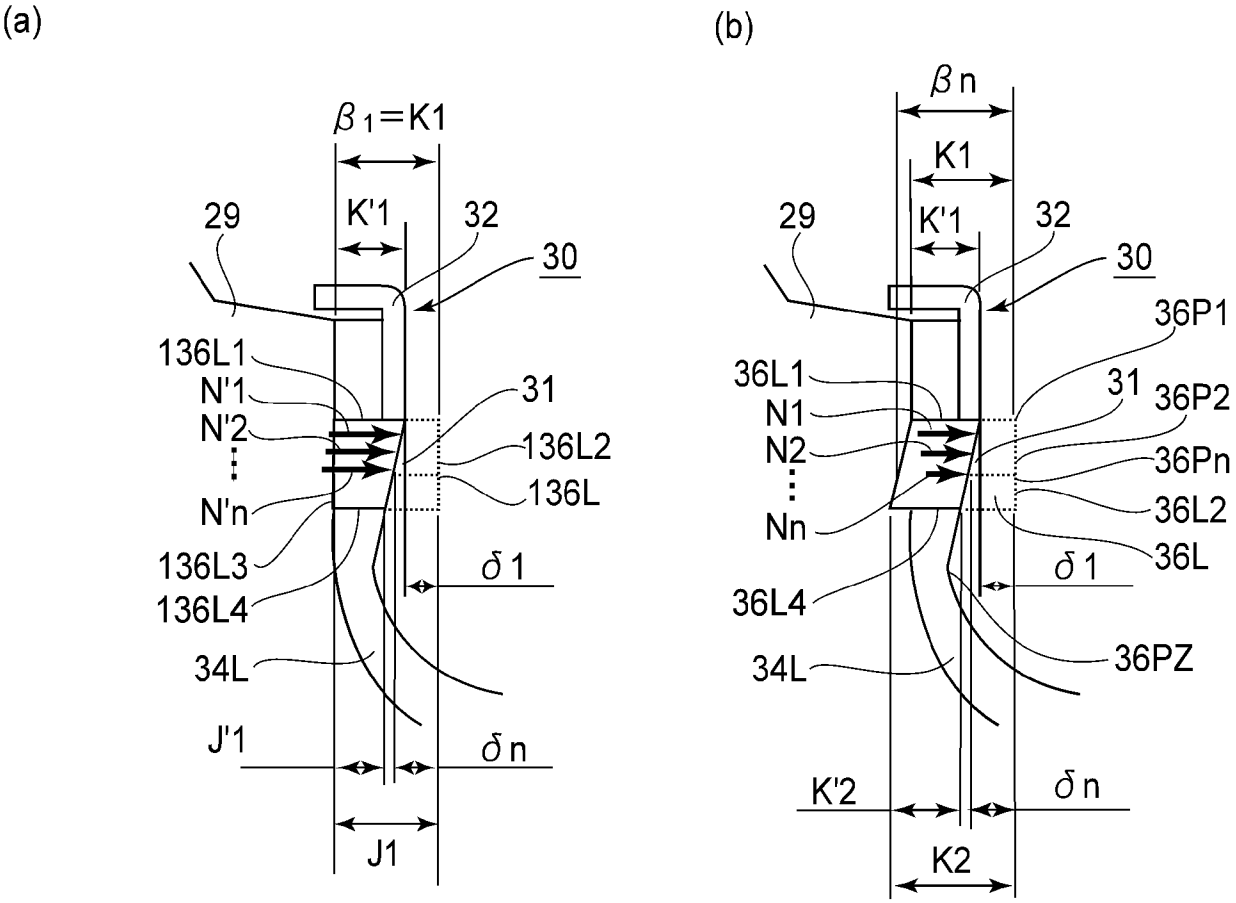
FIG. 18 is a schematic drawing for showing the internal stress of the development blade, which occurs as the development blade is bent.

Next, referring to FIGS. 17 and 18, the end portions 36L and 36R of the development blade bottom seal 36 in this embodiment are described. FIG. 17 is a schematic sectional drawing of the development blade unit 30 and development roller 6 in this embodiment, which is for describing the process for attaching the development blade unit 30 and development roller 6 to the development frame 29. More specifically, FIG. 17(*a*) is a schematic sectional view of the combination of the development frame 29, development blade bottom seal 36, and development blade unit 30, prior to the attachment of the development blade unit 30 in this embodiment. FIG. 17(*b*) is a schematic sectional view of the combination of the development frame 29, development blade bottom seal 36, and development blade unit 30, after the attachment of the development blade unit 30 in this embodiment. FIG. 17(*c*) is a schematic sectional view of the combination of the development frame 29, development blade bottom seal 36, development blade unit 30, development roller 6, after the attachment of the development blade unit 30 and development roller 6 in this embodiment. FIG. 18(*a*) is a schematic sectional view of the combination of the development frame 29 and development blade unit 30 of an example of conventional development device. It is for showing the internal stress of the development blade 31 when the development blade 31 is bent. FIG. 18(*b*) is a schematic sectional view of the combination of the development frame 29 and development blade 31 in this embodiment. It shows the internal stress of the development blade 31 when the development blade 31 is bent. Referring to FIGS. 18(*a*) and 18(*b*), the area contoured by a broken line shows the state of the end portion of the development blade bottom seal 36 prior to the attachment of the development blade 31. Since the end portions 36R and 36L are the same in structure, only the end portion 36L is described here.

Referring to FIG. 17(*a*), the development end seal 34L is adhered to the development end seal adhesion surface 29*a*1 of the development frame 29, as if it becomes an integral part of the development frame 29. The end portion 36L of the development blade bottom seal 36 is positioned in the gap created by the end surface 34L4 of the metallic support plate 32, back surface 31L2 of the development blade 31, end surface 34L4 of the development end seal 34L, and the surface 29L3 of the development frame 29 as shown in FIG. 17(*a*). Further, the development blade bottom seal 36 has the first surface 36L2 of airtight contact, which is airtightly placed in contact with the back surface 31L2 of the development blade 31, and the second surface 36L3 of airtight contact, which is airtightly placed in contact with the surface 29L3 of the development frame 29. Further, it has a surface 36L1, which comes into contact with the end surface 32L1 of the metallic support plate 32 during the assembly, and a surface 36L4, which comes into airtight contact with the end surface 34L4 of the development end seal 34. Thus, the toner in the development frame 29 is kept sealed in the development frame 29 by the airtight contact between the above described surfaces of the development blade bottom seal 36 and back surface 31L2 of the development blade 31, surface 29L3 of the development frame 29, end surface 32L1 of the metallic support plate 32, end surface 34L4 of the development end seal 34, one for one.

FIG. 17(*a*) shows the state of the end portion 36L of the development blade bottom seal 36 prior to the attachment of the development blade unit 30. In FIG. 17(*a*), a referential code K1 stands for the distance between the first and second surfaces 36L2 and 36L3 of airtight contact of the end portion 36L supported by the metallic support plate 32, at the base portion (point 31P1 of support), and a referential code K2 stands for the distance between the first and second surfaces 36L2 and 36L3 of airtight contact of the end portion 36L, at the end portion (31PZ side), which contacts the development roller 6. In this embodiment, the relationship between K1 and K2 is as follows:

$$K1<K2.$$

Referring also to FIG. 17(*a*), the development blade unit 30 is attached to the development frame 29 by being moved in the direction indicated by an arrow mark YG1. Next, referring to FIG. 17(*b*), as the development blade unit 30 is moved as described above, the end portion 36L of the development blade bottom seal 36, and development end seal 34L, are compressed by the development blade 31 in the direction (direction of compression) in the direction indicated by an arrow mark YG2. Further, referring to FIG. 17(*c*), as the development roller 6 is attached to the development frame 29, the development roller 6 comes into contact with the development blade 31, causing thereby the development blade 31 to bend in the direction indicated by the arrow mark YG2. Consequently, the distances K1 and K2 become distances K1' and K2'.

Here, referring to FIG. 18(*b*), a referential code 36P1 stands for the position of the base end side of the development blade bottom seal 36, relative to the surface 36L2, after the attachment of the development roller 6 and development blade 31. Referential codes 36P2, 36P3, . . . 36Pn stand for the positions of the points of the development blade bottom seal 36, which are apart from the base end of the seal 36 by multiples of a preset unit of distance, respectively. Further, a referential code 6*n* stands for the amount by which the development blade bottom seal 36L is compressed by the deformation of the development blade 31 at a position 36Pn. Further, a referential code βn stands for the distance between the first and second surfaces 36L2 and 36L3 of airtight contact 36L2 prior to the attachment of the development roller 6 and development blade 31 (starting point β1=K1).

The amount Nn of the reaction force to which the development blade 31 is subjected by the development blade bottom seal 36L at the position 36Pn on the first surface 36L2 of airtight contact during the attachment of the development blade 31 and development roller 6 can be expressed by the following equation (Equation 1) in which E stands for Young's modulus.

$$Nn=E(\delta n/\beta n) \tag{1}$$

The sum F of the reaction force to which the development blade 31 is subjected by the development blade bottom seal 36L can be expressed in the form of the following equation (Equation 2):

$$F=\sum_{k=1}^{n}(N_k) \tag{2}$$

Figure 19:
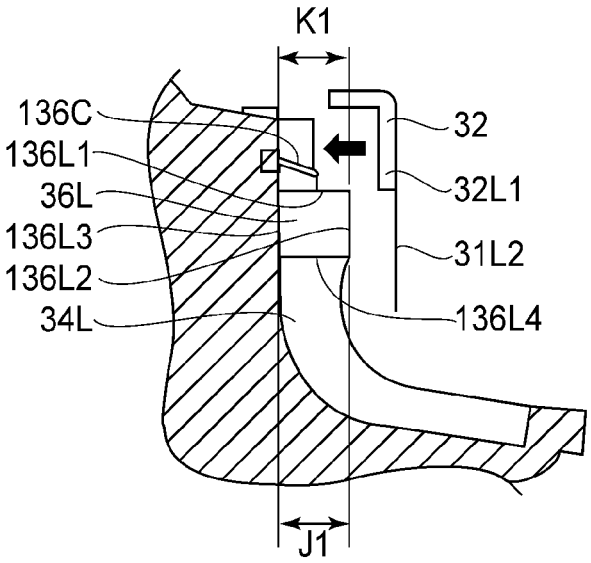
FIG. 19 is a schematic sectional a conventional development blade bottom seal.
Figure 19:
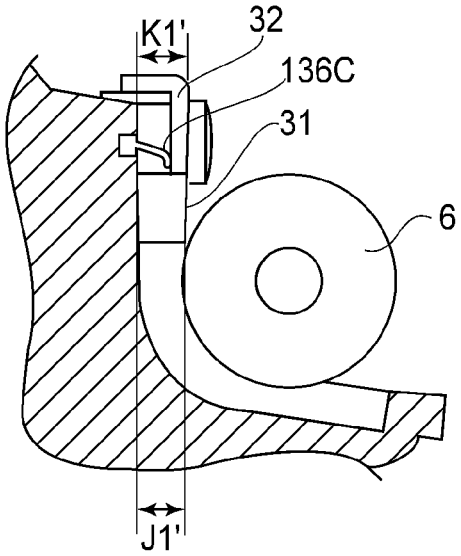

Here, referring to FIGS. 18(*a*) and 19, the structure of the conventional development blade bottom seal is described. FIG. 19 is a schematic sectional view of the conventional development blade bottom seal. Referring to FIGS. 18(*a*) and 19(*a*), in the case of the conventional development blade bottom seal, the distance between the first and second surfaces 136L2 and 136L3 at the point 36P1 is the same as that at the point 36Pn (K1=J1). Further, the amount of compression after the attachment of the development roller 6 is such that the closer to the base side, the smaller the amount; the farther from the base side, the greater the amount. Therefore, according to Equation 1 given above, βn remains unchanged (βn=K1=J1), whereas the closer to the fourth surface 136L4 of airtight contact, the greater the amount of βn. That is, the closer to the fourth surface 136L4 of airtight contact, the greater, the amount of reaction force N'n.

In comparison, referring to FIG. 18(*b*), in the case of the structure of the development blade bottom seal 36 in this embodiment, the relationship between the distance K1, that is, the distance between the first and second surfaces L2 and L3 of airtight contact at the point 36P1, and distance K2, that is, the distance between the first and second surfaces L2 and L3 of airtight contact at the point 36Pn is: K1<K2. Further, as for the amount of compression after the attachment of the development roller 6, it is such that it is smallest at the third surface 36L1 of airtight contact, and the closer to the fourth surface 34L4 of airtight contact, the greater it is. However, K1<K2. Therefore, δn increases. Thus, according to Equation 1, the reaction force Nn is smaller than the reaction force N1'n in the case of the conventional structure.

Therefore, according to the Equation 2, the development device 9 in this embodiment is smaller in the sum of the reaction force to which the development blade 31 is subjected, than the conventional development device. That is, according to this embodiment, it is possible to reduce the reaction force to which the development blade 31 is subjected as the end portion 36L of the development blade bottom seal 36 is compressed. Further, in comparison to the conventional development device, the development device 9 in this embodiment is structured so that the contact pressure between the development blade 31 and development roller 6 across the lengthwise end portions of the development blade 31 and development roller 6 is not unnecessarily high. Therefore, the development device 9 in this embodiment is smaller than the conventional development device, in the difference between the amount of contact pressure between the development blade 31 and development roller 6 at the lengthwise ends of the development blade 31, and that at the center portion of the development blade 6. Thus, the development device 9 in this embodiment is uniform in its ability to give electrical charge to toner, across the entire range in terms of the lengthwise direction. Therefore, it is possible to obtain a satisfactory image, more specifically, an image, the center portion and end portions of which in terms of the lengthwise direction of the development device 9, are not significantly different in density.

Further, referring to FIG. 17(*c*), the development device 9 in this embodiment is structured so that the development blade bottom seal 36 is positioned on the downstream side of the development end seal 34 in terms of the rotational direction of the development roller 6. Therefore, as the development roller 6 is rotated, such force that works in the direction to cause the development end seal 34 to be pressed upon the development blade bottom seal 36 is generated. That is, the portion of the development blade bottom seal 36, which contacts the development end seal 34, is increased in the amount of its compression. Therefore, it is likely that the reaction force which is generated in the development blade bottom seal 36, and to which the regulating edge portion of the development blade 31 is subjected is likely to increase. In this embodiment, however, the portion of the development blade bottom seal 36, which contacts the development end seal 34, is made thicker. Therefore, it is possible to reduce the amount by which the reaction force, to which the development blade 31 is subjected, is generated by the rotation of the development roller 6.

<Material for Development Blade Bottom Seal>

As for the material for the development blade bottom seal 3, it is desired that elastomer which belongs to styrene group is used as the material for the development blade bottom seal 36. Generally speaking, it is likely that the styrene resin is used as the material for the development frame. Thus, in a case where elastomer based on styrene is used as the material for the seals, both the development frame and seals are formed of the material based on styrene. Thus, as the seals are molded directly onto the development frame, they are excellent in terms of airtight adhesion to the development frame 29. Further, using styrene resin as the material for both the development frame and seals is advantageous in that it makes it unnecessary to separate the seals from the development frame when pulverizing the development frame and seals to recycle the development device 9, because both the development frame and seals are formed of the same material.

The structure of the development device 9 in this embodiment of the present invention was described assuming that elastomer was used as the material for the elastic components. However, the development device 9 may be structured so that a foamed substance is used as material for the elastic components, and the elastic components formed of the foamed substance are adhered to the development frame. As the material for the foamed substance, polyurethane based on ester, or ether, may be used. Using a foamed substance as the material for the elastic components makes it unnecessary to prepare molds and a molding machine, offering therefore a merit that it can reduce the initial investment for production facilities. Further, it is not mandatory that the development device 9 is structured so that the development end seal 34L and 34R directly contact the end portions 36L and 36R of the development blade bottom seal 36, respectively. That is, the development device 9 may be structured so that elastic seals are placed between the development end seal 34L and 34R and the end portions 36L and 36R of the development blade bottom seal 36, respectively. Further, the metallic support plate 32 may be eliminated; the development device 9 may be structured so that the blade 31 is directly attached to the development frame 29.

Further, referring to FIG. 18(*b*), in this embodiment, the development device 9 is structured so that the relationship between the distances K1 and K2 is linear. However, this embodiment is not intended to limit the present invention in terms of the relationship between the distances K1 and K2. That is, all that is necessary it that K1<K2. For example, the development device 9 may be structured so that the distance increases in steps. The effects of such an structural arrangement are the same as the structural arrangement for the development device 9 in this embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 194998/2012 filed Sep. 5, 2012, which is hereby incorporated by reference.

What is claimed is:

1. A frame for use with an image forming apparatus, the image forming apparatus comprising a developer carrying member, provided in said frame, and a regulating member including (i) a base portion supported by the frame and (ii) a blade portion contacted to the developer carrying member for regulating a layer thickness of the developer carried on the developer carrying member, the frame comprising:

a developer accommodating portion formed by the frame; and a sealing member provided said frame and contact to the regulating member to prevent leakage of the developer from said developer accommodating portion, wherein a thickness of a portion, which is a first part of the sealing member in a blade portion side, is thicker than a thickness of a second portion, which is a part of the sealing member in a base portion side.

2. A frame according to claim 1, wherein said sealing member is integrally molded with said frame.

3. A developing apparatus for use with an image forming apparatus, the developing apparatus comprising:

a frame;

a developer accommodating portion formed by said frame;

a developer carrying member, provided in said frame, for developing a latent image formed on an image bearing member with developer;

a regulating member for regulating a layer thickness of the developer carried on said developer carrying member, said regulating member including a base end portion supported by said frame, and a free end portion contacted to said developer carrying member; and a sealing member provided between said frame and said regulating member to prevent leakage of the developer from said developer accommodating portion in an axial direction of said developer carrying member at an end portion of said developer carrying member with respect to the axial direction, said sealing member having an elasticity, wherein, in a state before said developer carrying member is mounted to said frame, a thickness of a first portion, which is a part of said sealing member in a free end portion side, is thicker than a thickness of a second portion, which is a part of said sealing member in a base end portion.

4. An apparatus according to claim 3, wherein said sealing member is a first sealing member, and wherein a second sealing member is provided between said frame and said developer carrying member to prevent leakage of the developer in the axial direction at said end portion, said second sealing member contacting with the free end portion side of said first sealing member in a direction crossing the axial direction.

5. An apparatus according to claim 4, wherein the free end portion is between said developer carrying member and said second sealing member.

6. An apparatus according to claim 4, wherein said first sealing member is disposed downstream of said second sealing member with respect to a rotational moving direction of said developer carrying member.

7. An apparatus according to claim 3, wherein said sealing member is integrally molded with said frame.

8. A cartridge detachably mountable to a main assembly of an image forming apparatus; the cartridge comprising:

a frame;

a developer accommodating portion formed by said frame;

a developer carrying member, provided in said frame, for developing a latent image formed on an image bearing member with a developer;

a regulating member for regulating a layer thickness of the developer carried on said developer carrying member, said regulating member including a base end portion supported by said frame, and a free end portion contacted to said developer carrying member; and a sealing member provided between said frame and said regulating member to prevent leakage of the developer from said developer accommodating portion in an axial direction of said developer carrying member at an end portion of said developer carrying member with respect to the axial direction, said sealing member having an elasticity, wherein, in a state before said developer carrying member is mounted to said frame a thickness of a first portion, which is a part of said sealing member in a free end portion side, is thicker than a thickness of a second portion, which is a part of said sealing member in a base end portion side.

9. A cartridge according to claim 8, further comprising wherein said sealing member is a first sealing member, and wherein a second sealing member is provided between said frame and said developer carrying member to prevent leakage of the developer in the axial direction at said end portion of said developer carrying member, said second sealing member contacting with the free end portion side of said first sealing member in a direction crossing the axial direction.

10. A cartridge according to claim 9, wherein the free end portion is between the said developer carrying member and said second sealing member.

11. A cartridge according to claim 9, wherein said first sealing member is disposed downstream of said second sealing member with respect to a rotational moving direction of said developer carrying member.

12. A cartridge according to claim 8, wherein said sealing member is integrally molded with said frame.

13. A cartridge according to claim 8, wherein said cartridge is a process cartridge including said image bearing member.

14. A developing apparatus for use with an image forming apparatus, the developing apparatus comprising:

a frame;

a developer accommodating portion formed by said frame;

a developer carrying member, provided in said frame, for developing a latent image formed on an image bearing member with a developer;

a regulating member for regulating a layer thickness of the developer carried on said developer carrying member, said regulating member including a base end portion supported by said frame and a free end portion contacted to said developer carrying member; and a sealing member provided between said frame and said regulating member to prevent leakage of the developer from said developer accommodating portion in an axial direction of said developer carrying member at an end portion of said developer carrying member with respect to the axial direction, said sealing member being made of a elastomer material, wherein, in a state before said developer carrying member is mounted to said frame, a thickness of a first portion, which is a part of said sealing member in a free end portion side, is thicker than a thickness of a second portion, which is a part of said sealing member in a base end portion side.

15. An apparatus according to claim 14, wherein said sealing member is a first sealing member, and wherein a second sealing member is provided between said frame and said developer carrying member to prevent leakage of the developer in the axial direction at said end portion, said second sealing member contacting with the free end portion side of said first sealing member in a direction crossing the axial direction.

16. An apparatus according to claim 15, wherein said free end portion is between said developer carrying member and said second sealing member.

17. An apparatus according to claim 15, wherein said first sealing member is disposed downstream of said second sealing member with respect to a rotational moving direction of said developer carrying member.

18. An apparatus according to claim 14, wherein said sealing member is integrally molded with said frame.

19. A cartridge detachably mountable to a main assembly of an image forming apparatus, the cartridge comprising:

a frame;

a developer accommodating portion formed by said frame;

a developer carrying member, provided in said frame, for developing a latent image formed on an image bearing member with a developer;

a regulating member for regulating a layer thickness of the developer carried on said developer carrying member, said regulating member including a base end portion supported by said frame, and a free end portion contacted to said developer carrying member; and a sealing member provided between said frame and said regulating member to prevent leakage of the developer from said developer accommodating portion in an axial direction of said developer carrying member at an end portion of said developer carrying member with respect to the axial direction, said sealing member being made of a elastomer material, wherein, in a state before said developer carrying member is mounted to said frame, a thickness of a first portion, which is a part of said sealing member in a free end portion side, is thicker than a thickness of a second portion, which is a part of said sealing member in a base end portion side.

20. A cartridge according to claim 19, wherein said sealing member is a first sealing member, and wherein a second sealing member is provided between said frame and said developer carrying member to prevent leakage of the developer in the axial direction at said end portion of said developer carrying member, said second sealing member contacting with the free end portion side of said first sealing member in a direction crossing the axial direction.

21. A cartridge according to claim 20, wherein said free end portion is between said developer carrying member and said second sealing member.

22. A cartridge according to claim 20, wherein said first sealing member is disposed downstream of said second sealing member with respect to a rotational moving direction of said developer carrying member.

23. A cartridge according to claim 19, wherein said sealing member is integrally molded with said frame.

24. A cartridge according to claim 19, wherein said cartridge is a process cartridge including said image bearing member.

25. A frame for use with an image forming apparatus, the image forming apparatus comprising a developer carrying member, provided in said frame, and a regulating member including (i) a base portion supported by the frame and (i) a blade portion contacted to the developer carrying member for regulating a layer thickness of the developer carried on the developer carrying member, the frame comprising:

a developer accommodating portion formed by the frame; and a sealing member provided said frame and contact to the regulating member to prevent leakage of the developer from said developer accommodating portion, said sealing member is made of a elastomer material, wherein a thickness of a first portion, which is a part of said sealing member in a blade portion side, is thicker than a thickness of a second portion, which is a part of said sealing member in a base portion side.

26. A frame according to claim 25, wherein said sealing member is integrally molded with the frame.

* * * * *